US006294319B1

(12) United States Patent
Kondo et al.

(10) Patent No.: US 6,294,319 B1
(45) Date of Patent: Sep. 25, 2001

(54) SILVER HALIDE PHOTOGRAPHIC EMULSION

(75) Inventors: Toshiya Kondo; Norio Miura, both of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/327,125

(22) Filed: Jun. 7, 1999

(30) Foreign Application Priority Data

Jun. 10, 1998 (JP) ..... 10-162141

(51) Int. Cl.[7] ..... G03C 1/035
(52) U.S. Cl. ..... 430/569; 430/567
(58) Field of Search ..... 430/567, 569

(56) References Cited

U.S. PATENT DOCUMENTS 5,061,615 * 10/1991 Kase et al. ..... 430/569
5,393,653 * 2/1995 Kawai ..... 430/569
5,972,588 * 10/1999 Nabeta ..... 430/567
5,985,534 * 11/1999 Maruyama ..... 430/567
6,183,946 * 2/2001 Ochiai ..... 430/567

FOREIGN PATENT DOCUMENTS 7-114141 * 2/1995 (JP) .

* cited by examiner

*Primary Examiner*—Janet Baxter
*Assistant Examiner*—Amanda C. Walke
(74) *Attorney, Agent, or Firm*—Frishauf, Holtz, Goodman, Langer & Chick, P.C.

(57) ABSTRACT

A method for preparing a silver halide emulsion is disclose, wherein during the course of preparing a silver halide emulsion, a compound having a group capable of releasing a bromide ion or iodide ion and represented by the following formula is used:

$$\{X—(L_1)_{n1}\}_{n2}—L_2—(SOL)_m$$

wherein X represents a chlorine atom or a bromine atom; $L_1$ and $L_2$ each represent a bivalent linkage group; SOL represents a water-solubilizing group.

11 Claims, No Drawings

SILVER HALIDE PHOTOGRAPHIC EMULSION

FIELD OF THE INVENTION

The present invention relates to silver halide photographic emulsions, and in particular to a preparation method of silver halide photographic emulsions with superior sensitivity and graininess and a silver halide light sensitive photographic materials by use thereof.

BACKGROUND OF THE INVENTION

Recently, along with the increased popularity of picture-taking instruments such as cameras, there increase picture-taking chances by use of a silver halide light sensitive photographic material (hereinafter, also referred to as a photographic material). As a result, further enhancement in sensitivity and image quality has been desired by the public.

One dominant factor for enhancing sensitivity and image quality of the photographic material concerns silver halide grains, and there has been on going development of silver halide grains aimed at enhancement of sensitivity and image quality. As is well recognized in the art, however, in conjunction with decreasing the silver halide grain size for enhancing image quality, the sensitivity tends to be lowered, and enhancing both sensitivity and image quality has its limits.

JP-A5-323487, 6-11781, 6-11782, 6-27564, 6-250309, 6-250310, 6-250311, 6-250313 and 6-242527 each disclose techniques for achieving enhanced sensitivity and improved fog and pressure resistance by the use of an iodide ion-releasing compound during grain formation.

However, the prior art described above is limited in achieving enhancement of both sensitivity and image quality and insufficient for satisfying requirements in recent photographic materials, therefore, development of a technique superior to the prior art is desired.

SUMMARY OF THE INVENTION

An object of the present invention relates to a preparation method of a silver halide photographic emulsion and particularly to a method of uniformly supplying, among silver halide grains, halide ions other than an iodide ion, which are to be included in the interior and exterior of silver halide grains, leading to characteristic localization of silver halide composition in the interior and exterior of the grain.

Thus, it is an object of the present invention to provide a method for preparing a silver halide emulsion with superior sensitivity and graininess and a silver halide light sensitive photographic material by use thereof.

The above object of the invention can be accomplished by the following constitution:

a method for preparing a silver halide emulsion comprising the steps of:

(1) forming a silver halide grain emulsion, (2) subjecting the formed silver halide emulsion to desalting to remove soluble salts, (3) subjecting the silver halide emulsion to spectral and/or chemical sensitization, and (4) preparing a coating solution using the spectrally and/or chemically sensitized silver halide emulsion, wherein in any of the steps (1) to (4), a compound represented by the following formula (I) is incorporated into the silver halide emulsion:

formula (I)

$$\{X-(L_1)_{n1})\}_{n2}-L_2-(SOL)_m$$

wherein X represents a chlorine atom or a bromine atom; $L_1$ and $L_2$ each represent a bivalent linkage group; SOL represents a water-solubilizing group; n1 is 0 or 1; and m and n2 each are an integer of 1 to 4.

DETAILED DESCRIPTION OF THE INVENTION

The compound for use in silver halide photographic materials relating to the invention can reduce inhomogeniety of the bromide or chloride content among silver halide grains, leading to enhanced relationship between speed and granularity. Comparing cases of forming an iodide by use of an iodide releasing compound, the compound has little adverse effect on photographic performance, such as development restraining and is broadly applicable to high chloride silver halide emulsions.

The process of preparing a photographic emulsion and a silver halide photographic material comprises the steps of formation of silver halide grains, desalting, spectral sensitization, chemical sensitization, preparation of coating solutions, coating, and drying. The compound for use in photographic materials, characterized in that the compound contain a substituent capable of releasing a bromide or chloride ion (hereinafter, also denoted as a compound of the invention), can be used in at least one step from the start of forming silver halide grains to the start of coating photographic material.

The formation of silver halide grains includes formation of silver halide nucleus grains (nucleation), crystal growth of the nucleus grains and physical ripening of the grains; therefore it includes any process prior to emulsion washing to remove soluble salts.

The compound of the invention can be used at any stage of the process for preparing a silver halide emulsion, preferably at a step after forming 80% of final grains, based on silver. Thus, the compound is used preferably at the latter stage of silver halide grain formation, desalting, spectral sensitization, chemical sensitization stages and the stage of preparing a coating solution. Further, the compound is incorporated more preferably at the step after desalting and prior to spectral sensitization and/or chemical sensitization, or at the stage after completion of spectral sensitization and/or chemical sensitization and before completion of preparing of a coating solution.

When the compound of the invention is added in the process of preparing a silver halide emulsion, the compound may be directly dispersed in an emulsion or dissolved in a single or mixed solvent, such as water, methanol or ethanol, and any method known in the art of adding an additive to a silver halide emulsion can be applicable. The compound can be added preferably in an amount of $1\times10^{-7}$ to 30 mol %, and more preferably $1\times10^{-5}$ to 5 mol % per mol of silver halide.

The compound of the invention may be used by adding to the silver halide emulsion and after addition, optionally allowed to release a bromide or chloride ion upon reaction with a base and/or a nucleophilic agent. The base and nucleophilic agent may be used in combination thereof. Examples of the nucleophilic agent usable in the invention include a hydroxide ion, a sulfite ion, hydroxyamines, hydroxamic acids, a metabisulfite ion, a thiosulfate ion, oximes, mercaptans, a sulfinate, a carboxylate, an ammonium compound, an amine compound, phenols, alcohols, thioureas, ureas, hydrazines, sulfides and phosphines. Of these, an alkali metal hydroxide is preferred. Timing or the rate of releasing a bromide or chloride ion can be controlled by the method of adding the nucleophilic agent or base, the concentration or the reaction temperature. The concentration of the base and/or nucleophilic agent is preferably $1\times10^{-7}$ to 50 M (molar concentration, mol/l), more preferably $1\times10^{-5}$ to 10 mol, and still more preferably $1\times10^{-3}$ to 5 mol. The temperature is preferably 20 to 90° C., more preferably 30 to 85° C., and still more preferably 35 to 80° C. In cases where a base is used for releasing a bromide or chloride ion, the pH may be controlled. The pH is preferably 7 to 12, and more preferably 8 to 11. The released bromide or chloride ion is preferably 0.001 to 30 mol % and more preferably 0.01 to 10 mol %, based on silver halide. A compound which contains a adsorption group onto silver halide and a substituent capable of releasing a halide ion, may release all or a part of halide atom(s) contained in the compound. The compound is one releasing a bromide ion or chloride ion, and preferably a bromide ion or iodide ion, and preferably a chloride ion releasing compound. The compound may be used alone or in combination.

The compound which intramolecularly contains a substituent capable of releasing a bromide or chloride ion, is preferably represented by the following formula (I):

$$\{X—(L_1)_{n1}\}_{n2}—L_2—(SOL)_m \qquad \text{formula (I)}$$

wherein X represents a chlorine or bromine atom; $L_1$ and $L_2$ each represent a bivalent linkage group; SOL represents a water-solubilizing group; n1 is 0 or 1; m and n2 each are an integer of 1 to 4.

Further, $L_1$ of formula (I) is preferably represented by formula (II):

$$—C(R_1)(R_2)—C(R_3)(R_4)—EWG— \qquad \text{formula (II)}$$

wherein $R_1$, $R_2$ and $R_3$ each represent a hydrogen atom or a substituent; EWG represents —COO—, —OCO—, —$SO_2$—, —$SO_2O$—, —CON($R_4$)—, —N($R_4$)CO—, —CSN($R_4$)—, —N($R_4$)CS—, —N($R_4$)—, —O—, —S—, —CO—, —CS—, —COCO—, —$SO_2N(R_4)$— or —N($R_4$)$SO_2$—; and $R_4$ represents a hydrogen atom, an alkyl group or an aryl group.

Formula (I) will be further explained. In formula (I), X is a chlorine or bromine atom, and preferably a chlorine atom. A bivalent linkage group represented by $L_1$ is preferably an aliphatic group, an aromatic group or a heterocyclic group and a group obtained by allowing any of these group to link with —COO—, —OCO—, —$SO_2$—, —$SO_2O$—, —CON($R_4$)—, —N($R_4$)CO—, —CSN($R_4$)— or —N($R_4$)CS—; preferably a group obtained by allowing a bivalent aliphatic group to link with —COO—, —OCO—, —$SO_2$—, —$SO_2O$—, —CON($R_4$)—, —N($R_4$)CO—, —CSN($R_4$)— or —N($R_4$)CS—; and still more preferably a group represented by formula (II); n1 is 0 or 1 and preferably 1; and n2 is an integer of 1 to 4, preferably 1 or 2, and more preferably 1. A bivalent linkage group represented by $L_2$ is preferably an aliphatic group, an aromatic group or a heterocyclic group, more preferably an aromatic group, and still more preferably a phenylene group. "SOL" represents a water-solubilizing group and preferred examples thereof include carboxy group, sulfo group, hydroxy group, and quaternary ammonium group. Of these is preferred a sulfo group. The carboxy or sulfo group is preferably in the form of an alkaline metal salt in terms of enhancing aqueous solubility. m is an integer of 1 to 4, preferably 1 or 2, and more preferably 1.

Formula (II) will be further explained. Substituents represented by $R_1$, $R_2$ and $R_3$ include an alkyl group, aralkyl group, alkenyl group, alkynyl group, alkoxy group, aryl group, substituted amino group, ureido group, urethane group, aryloxy group, sulfamoyl group, carbamoyl group, alkylthio group, arylthio group, alkylsulfonyl group, arylsulfonyl group, alkylsulfinyl group, arylsulfinyl group, hydroxy, halogen atom, cyano, sulfo, aryloxycarbonyl group, acyl group, alkoxycarbonyl group, acyloxy group, carbonamido group, sulfonamido group, carboxy, phosphoric acid amido group, diacylamino group and imido group. $R_1$, $R_2$ and $R_3$ is preferably a hydrogen atom. "EWG" represents —COO—, —OCO—, —$SO_2$—, —$SO_2O$—, —CON($R_4$)—, —N(R,)CO—, —CSN($R_4$)—, —N($R_4$)CS—, —N($R_4$)—, —O—, —S—, —CO—, —CS—, —COCO—, —$SO_2N(R_4)$— or —N($R_4$)$SO_2$—, in which $R_4$ represents a hydrogen atom, an alkyl group or an aryl group, and preferably a hydrogen atom.

Exemplary examples of the compound of the invention are shown below, but the compound is not limited to these examples.

CL-1

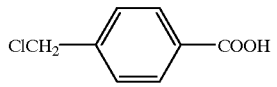

CL-2

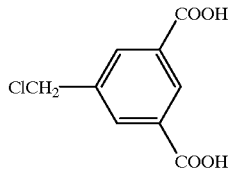

CL-3

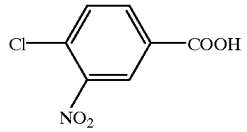

CL-4

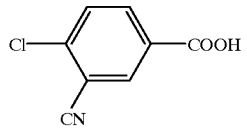

CL-5

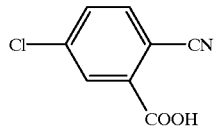

CL-6

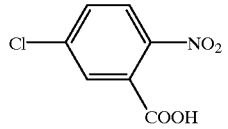

CL-7

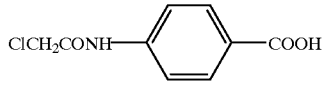

-continued
CL-8
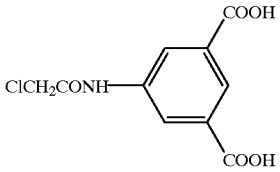
CL-9
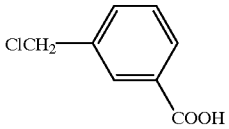
CL-10
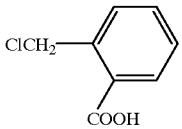
CL-11
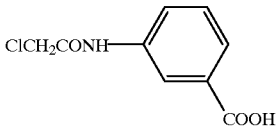
CL-12
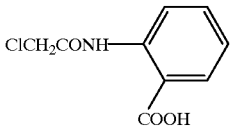
CL-13
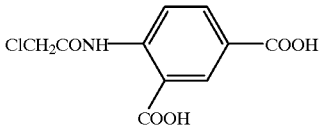
CL-14
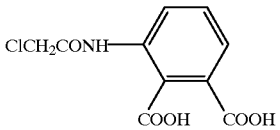
CL-15
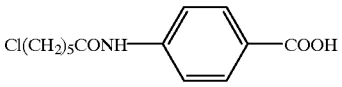
CL-16
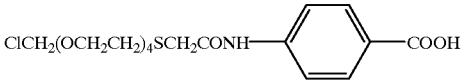
CL-17
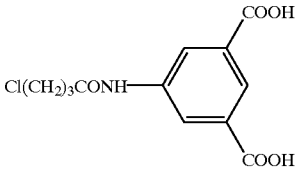
CL-18
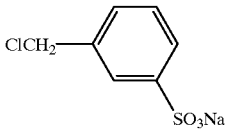
-continued
CL-19
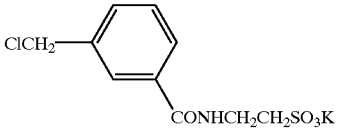
CL-20
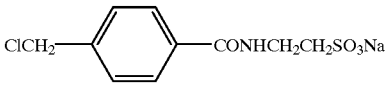
CL-21
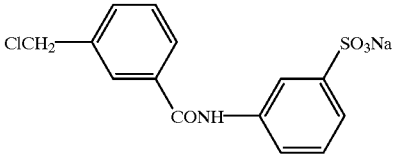
CL-22
$ClCH_2CONHCH_2CH_2SO_3Na$
CL-23
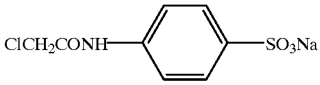
CL-24
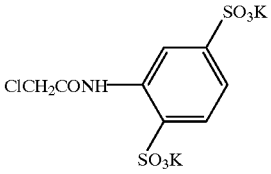
CL-25
$ClCH_2CH_2SO_3Na$
CL-26
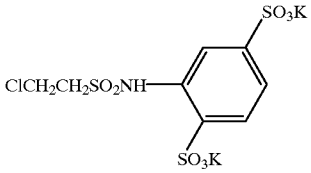
CL-27
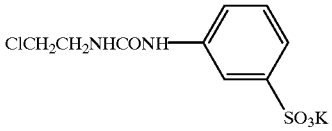
CL-28
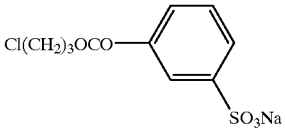
CL-29
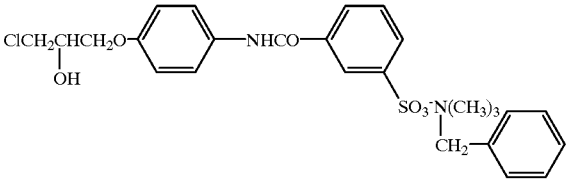

-continued
CL-30
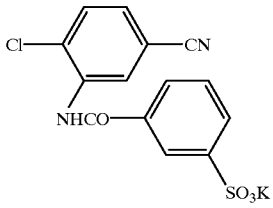
CL-31
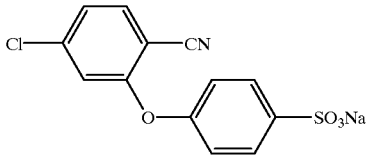
CL-32
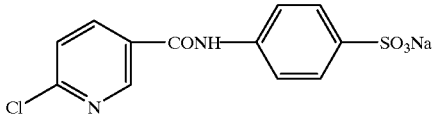
CL-33
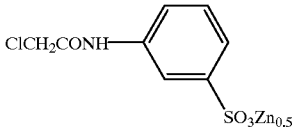
CL-34
$ClCH_2CH_2OH$
CL-35
$Cl(CH_2)_3OH$
CL-36
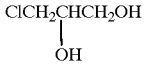
CL-37
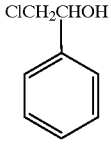
CL-38
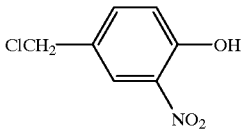
CL-39
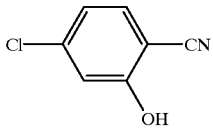
CL-40
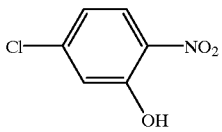
CL-41
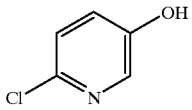
CL-42
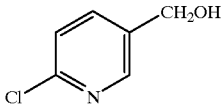
CL-43
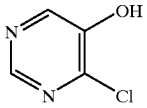
CL-44
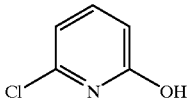
CL-45
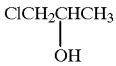
CL-46
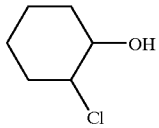
CL-47
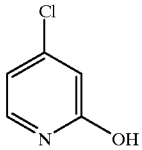
CL-48
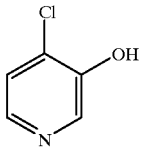
CL-49
$ClCHCH_2^+N(CH_3)_3 \cdot CF_3SO_3^-$
CL-50
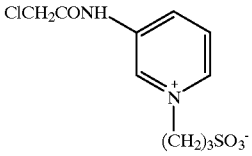
CL-51
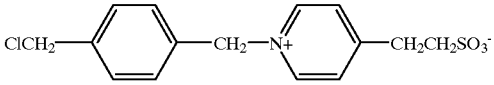
CL-52
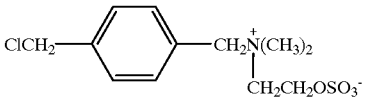
CL-53
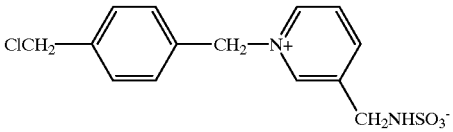

-continued
CL-54
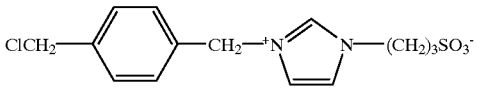
CL-55
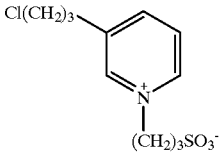
CL-56
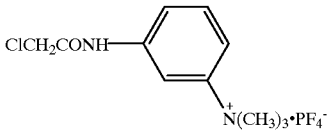
CL-57
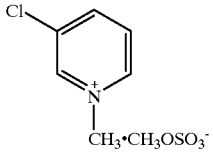
CL-58
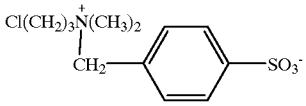
CL-59
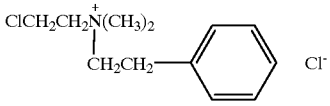
CL-60
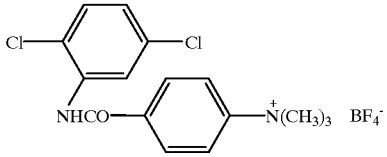
CL-61
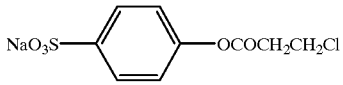
CL-62
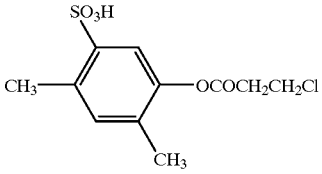
CL-63
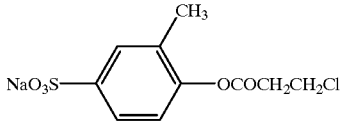
-continued
CL-64
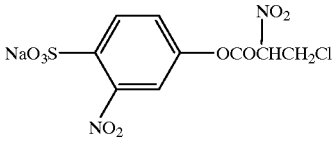
CL-65
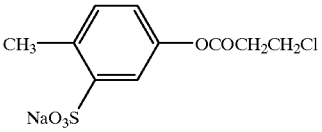
CL-66
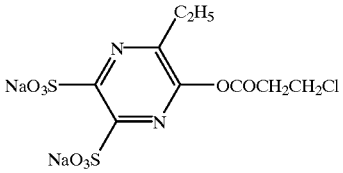
CL-67
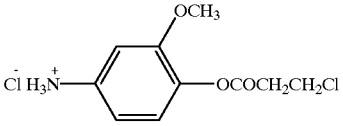
CL-68
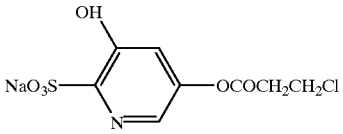
CL-69
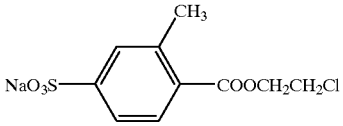
CL-70
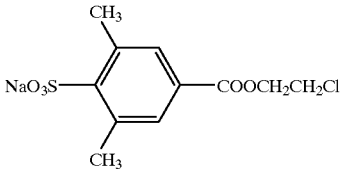
CL-71
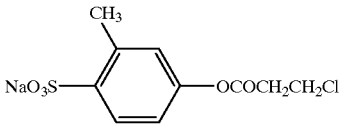
CL-72
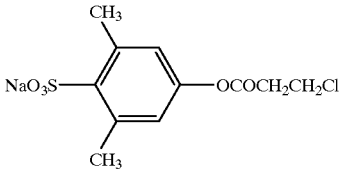

-continued
CL-73
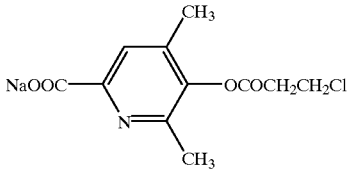
CL-74
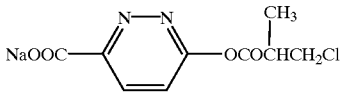
CL-75
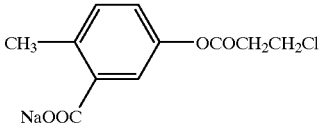
CL-76
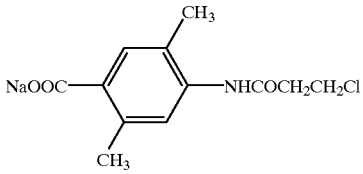
CL-77
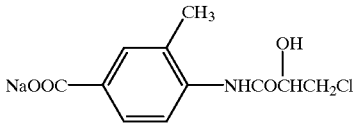
CL-78
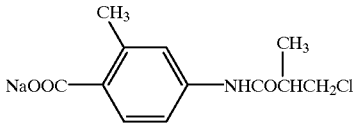
CL-79
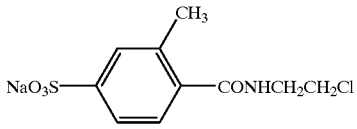
CL-80
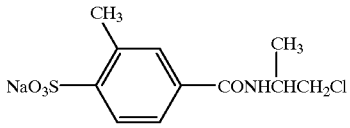
CL-81
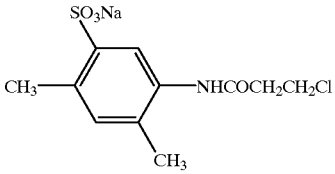
CL-82
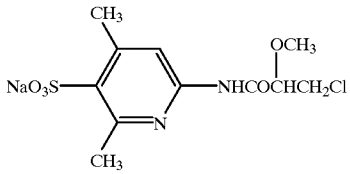
-continued
CL-83
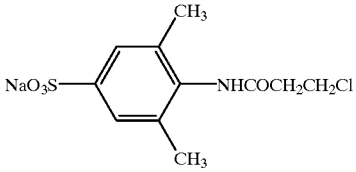
CL-84
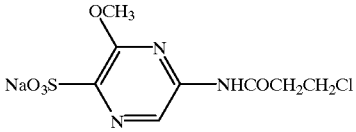
CL-85
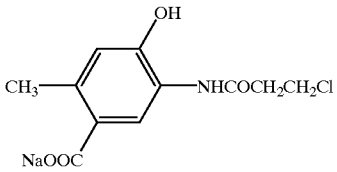
CL-86
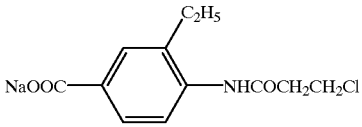
CL-87
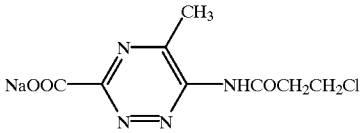
CL-88
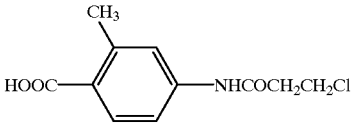
CL-89
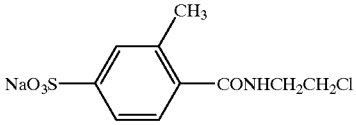
CL-90
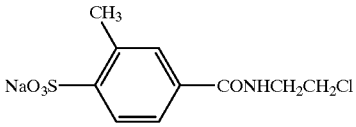
CL-91
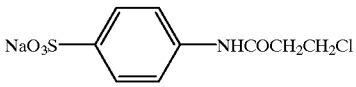
CL-92
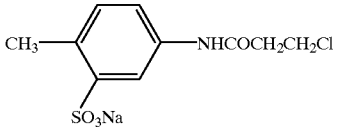

-continued
CL-93
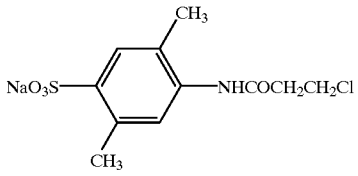
CL-94
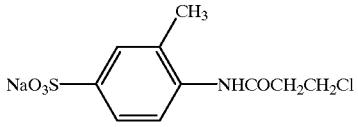
CL-95
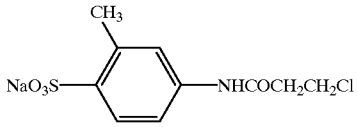
CL-96
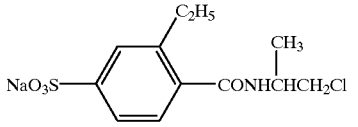
CL-97
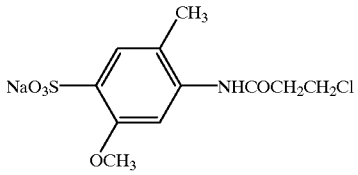
CL-98
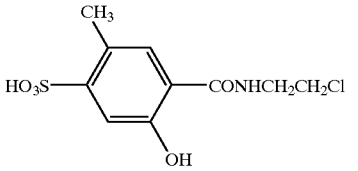
CL-99
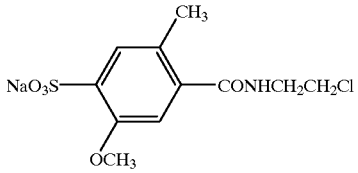
CL-100
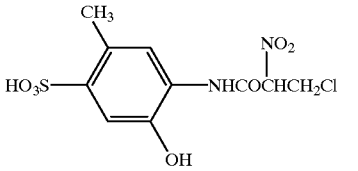
CL-101
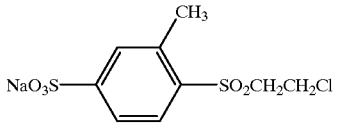
-continued
CL-102
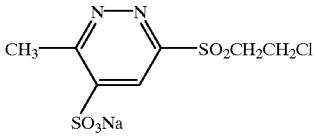
CL-103
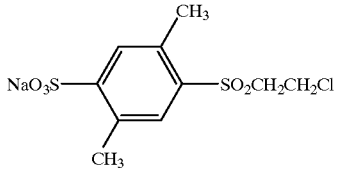
CL-104
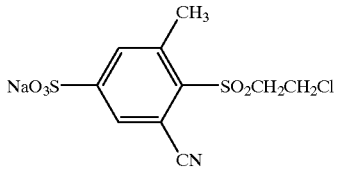
CL-105
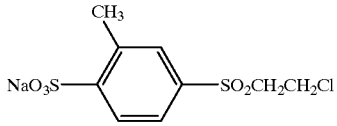
CL-106
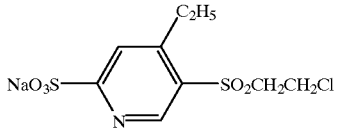
CL-107
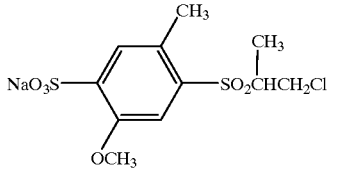
CL-108
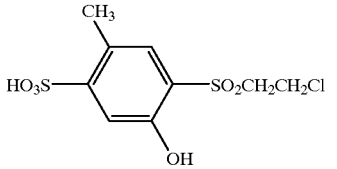
CL-109
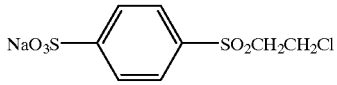
CL-110
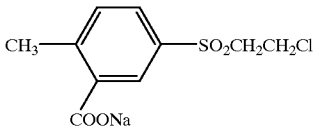
CL-111
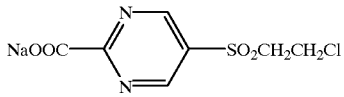

-continued
CL-112
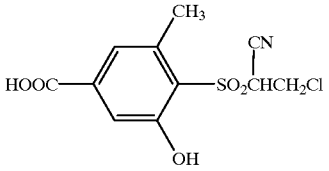
CL-113
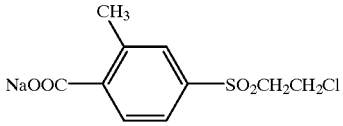
CL-114
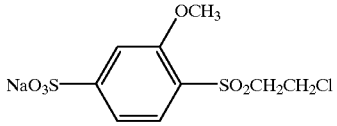
CL-115
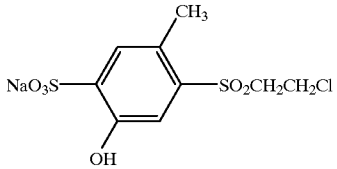
CL-116
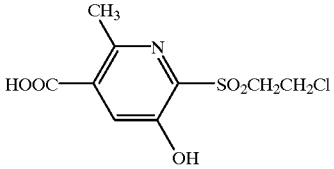
CL-117
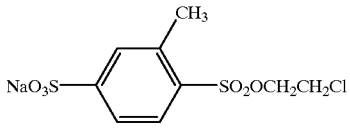
CL-118
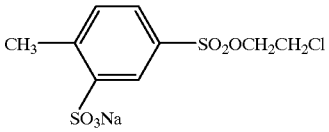
CL-119
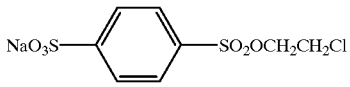
CL-120
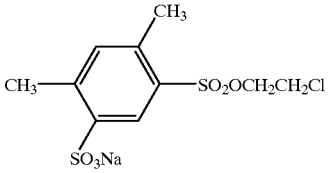
CL-121
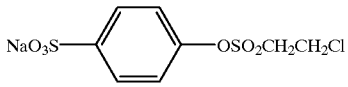
-continued
CL-122
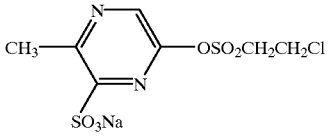
CL-123
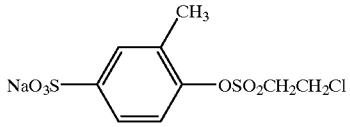
CL-124
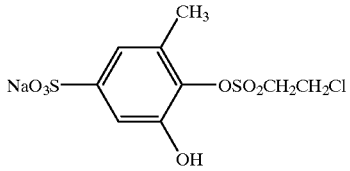
CL-125
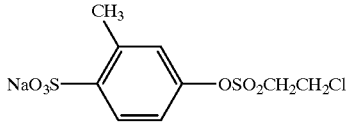
CL-126
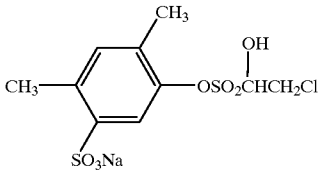
CL-127
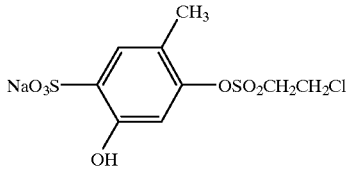
CL-128
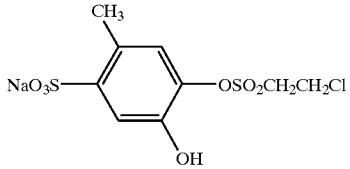
CL-129
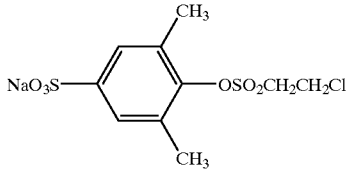
CL-130
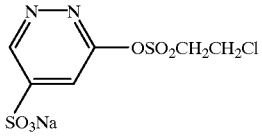

-continued
CL-131
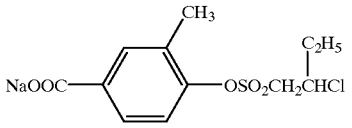
CL-132
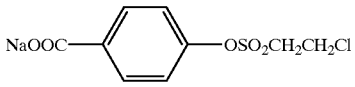
CL-133
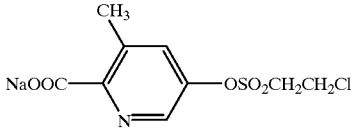
CL-134
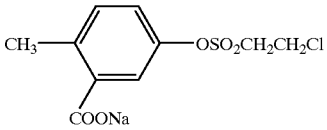
CL-135
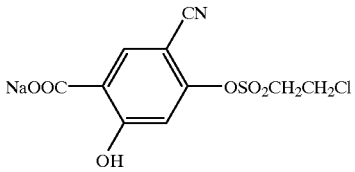
CL-136
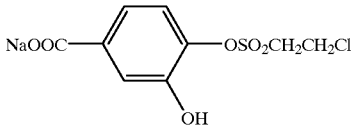
CL-137
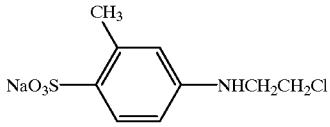
CL-138
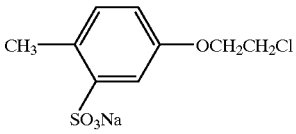
CL-139
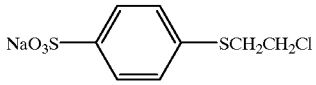
CL-140
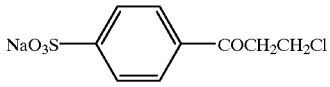
CL-141
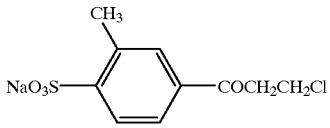
-continued
CL-142
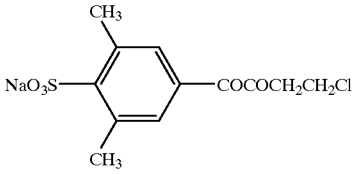
CL-143
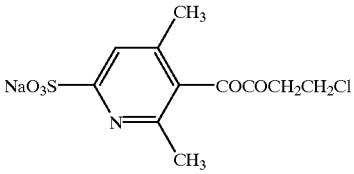
CL-144
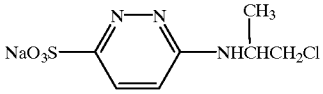
CL-145
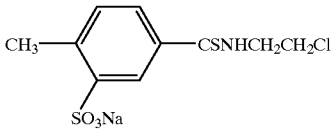
CL-146
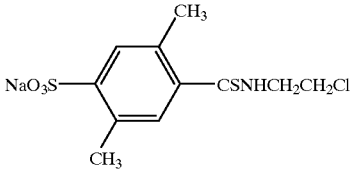
CL-147
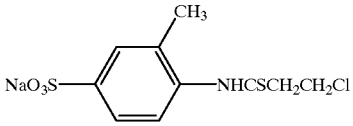
CL-148
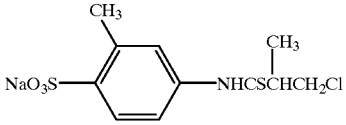
CL-149
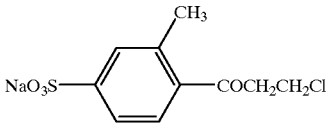
CL-150
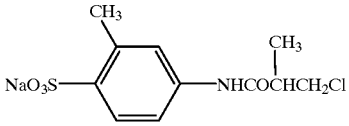
CL-151
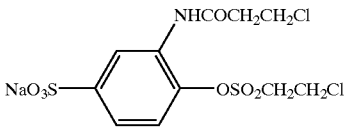

-continued
CL-152
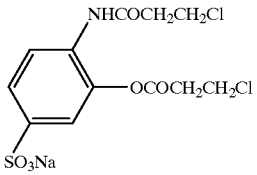
CL-153
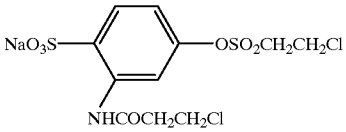
CL-154
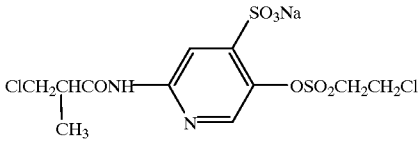
CL-155
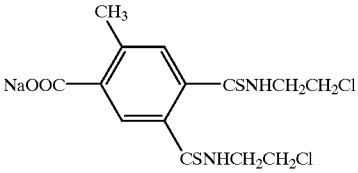
CL-156
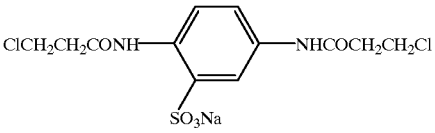
CL-157
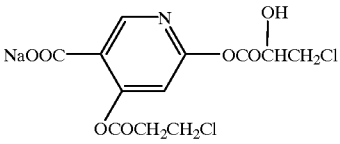
CL-158
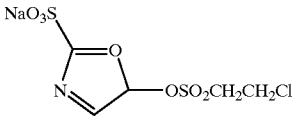
CL-159
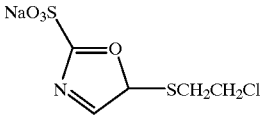
BR-1
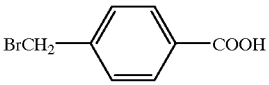
BR-2
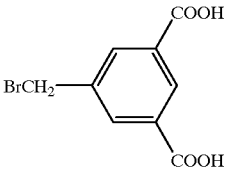
-continued
BR-3
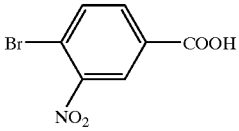
BR-4
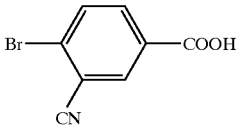
BR-5
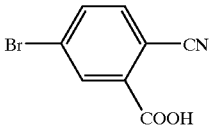
BR-6
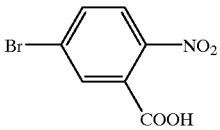
BR-7
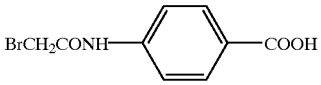
BR-8
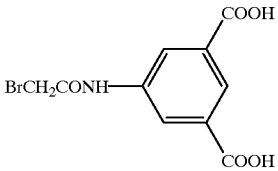
BR-9
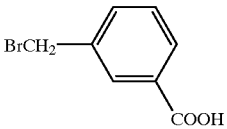
BR-10
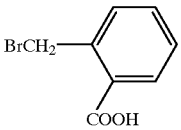
BR-11
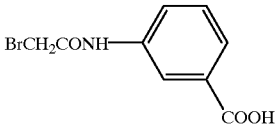
BR-12
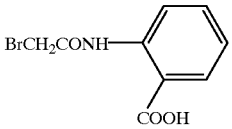

-continued
BR-13
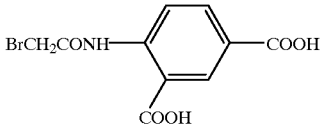
BR-14
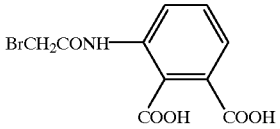
BR-15
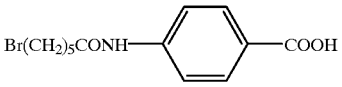
BR-16
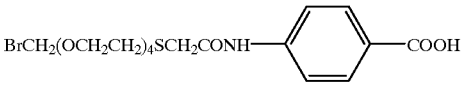
BR-17
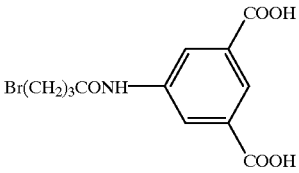
BR-18
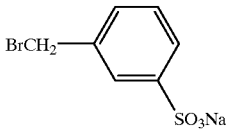
BR-19
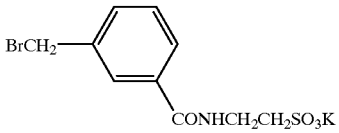
BR-20
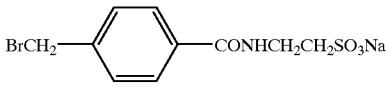
BR-21
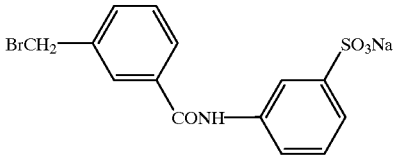
BR-22
$BrCH_2CONHCH_2CH_2SO_3Na$
BR-23
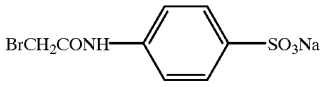
-continued
BR-24
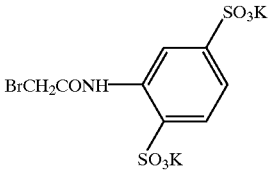
BR-25
$BrCH_2CH_2SO_3Na$
BR-26
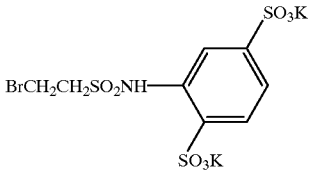
BR-27
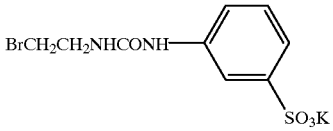
BR-28
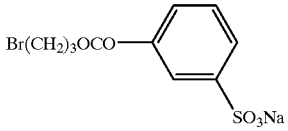
BR-29
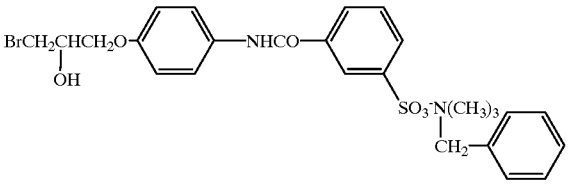
BR-30
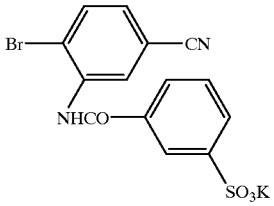
BR-31
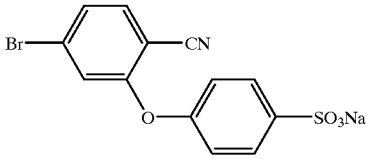
BR-32
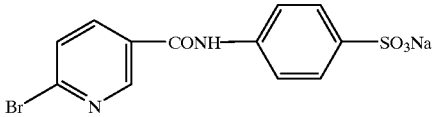

-continued
BR-33
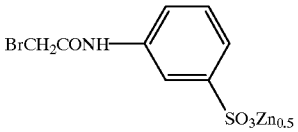
BR-34
$BrCH_2CH_2OH$
BR-35
$Br(CH_2)_3OH$
BR-36
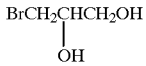
BR-37
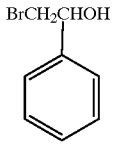
BR-38
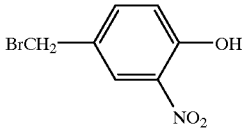
BR-39
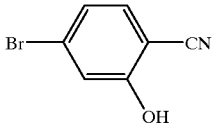
BR-40
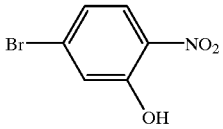
BR-41
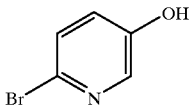
BR-42
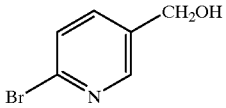
BR-43
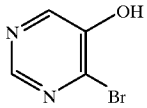
BR-44
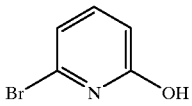
BR-45
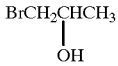
-continued
BR-46
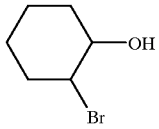
BR-47
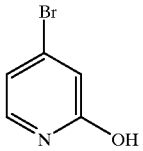
BR-48
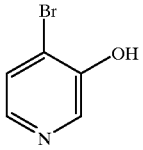
BR-49
$BrCHCH_2^{+}N(CH_3)_3 \cdot CF_3SO_3^-$
BR-50
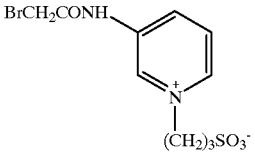
BR-51
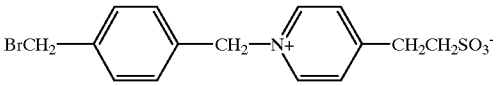
BR-52
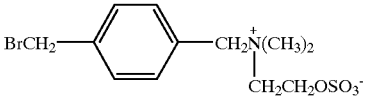
BR-53
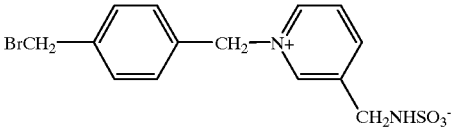
BR-54
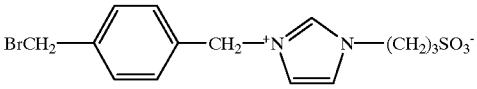
BR-55
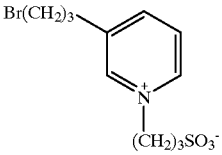
BR-56
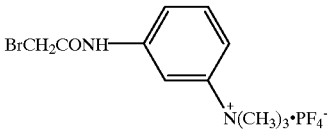

-continued
BR-57
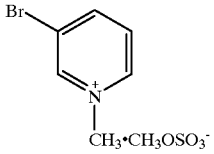
BR-58
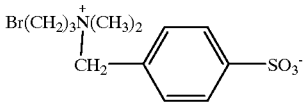
BR-59
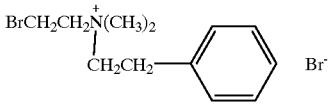
BR-60
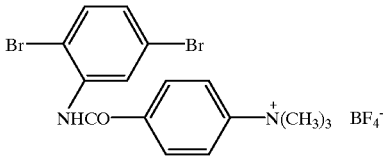
BR-61
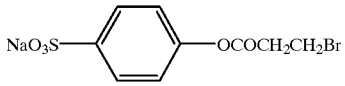
BR-62
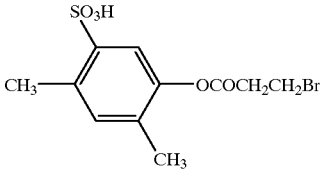
BR-63
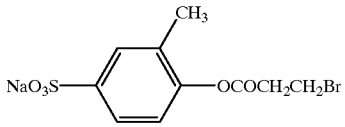
BR-64
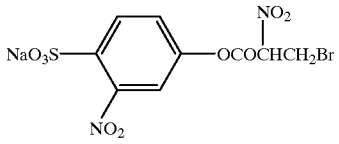
BR-65
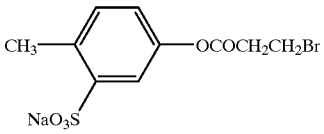
BR-66
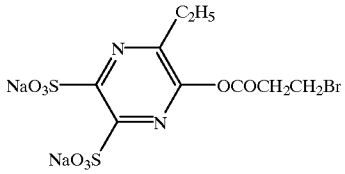
-continued
BR-67
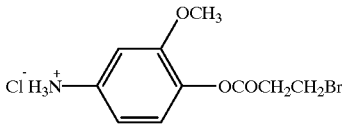
BR-68
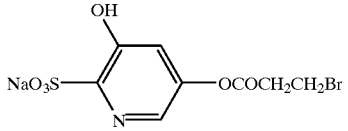
BR-69
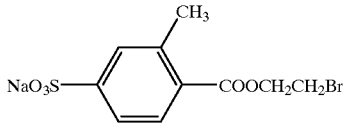
BR-70
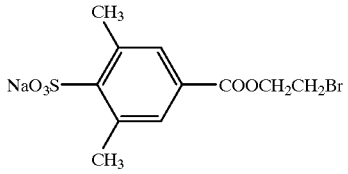
BR-71
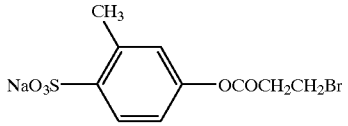
BR-72
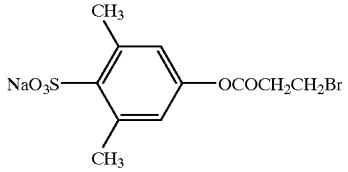
BR-73
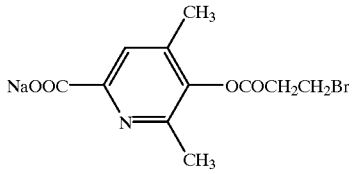
BR-74
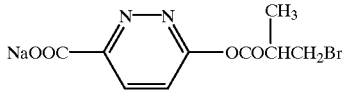
BR-75
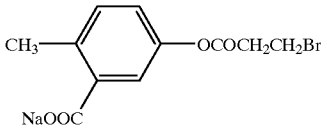
BR-76
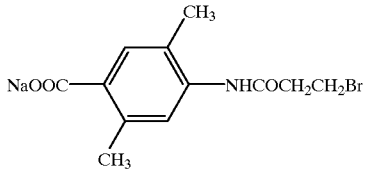

-continued
BR-77
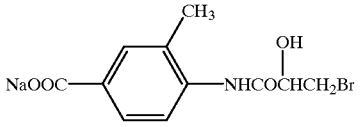
BR-78
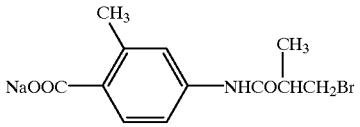
BR-79
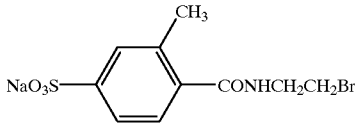
BR-80
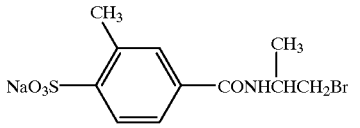
BR-81
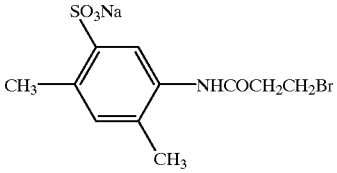
BR-82
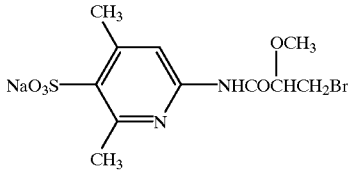
BR-83
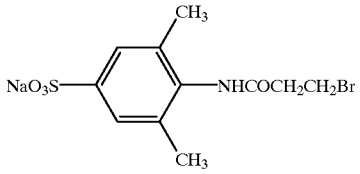
BR-84
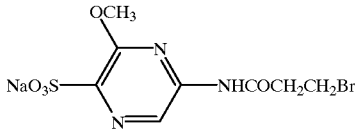
BR-85
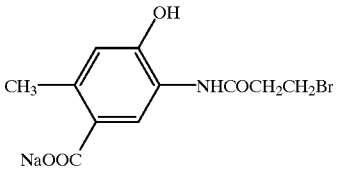
-continued
BR-86
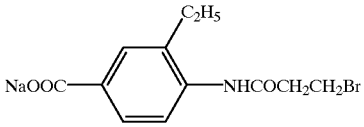
BR-87
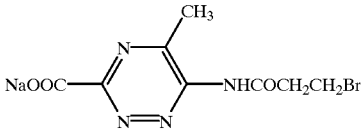
BR-88
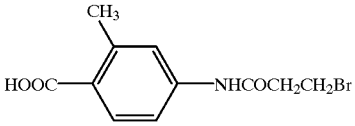
BR-89
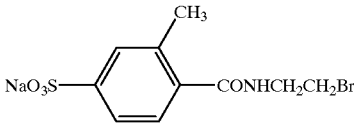
BR-90
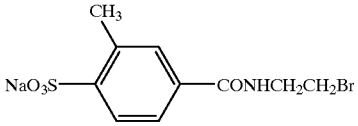
BR-91
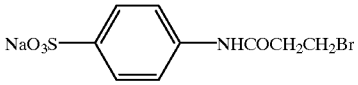
BR-92
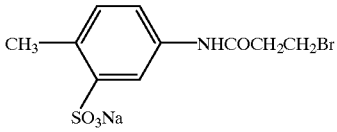
BR-93
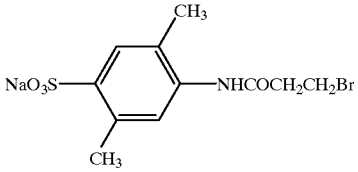
BR-94
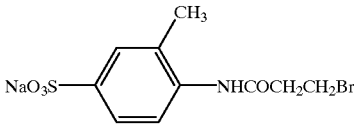
BR-95
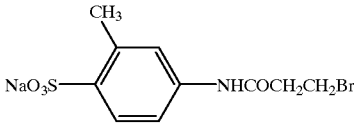
BR-96
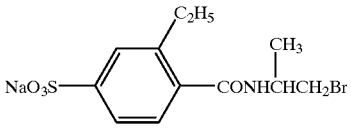

-continued
BR-97
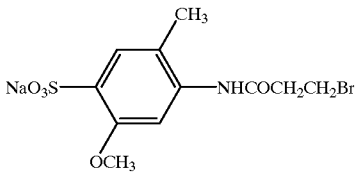
BR-98
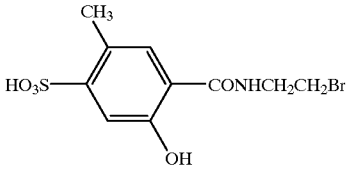
BR-99
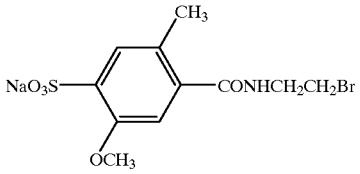
BR-100
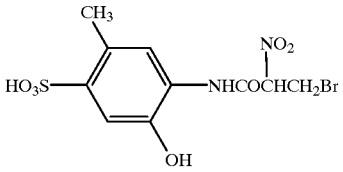
BR-101
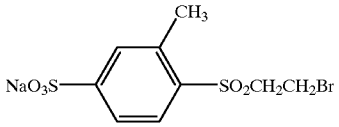
BR-102
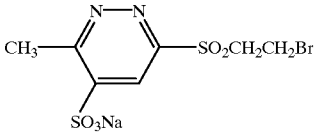
BR-103
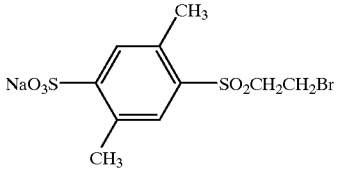
BR-104
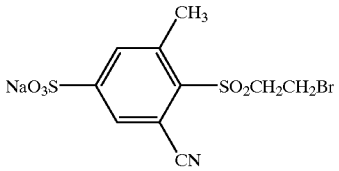
BR-105
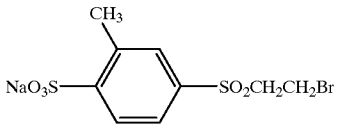
-continued
BR-106
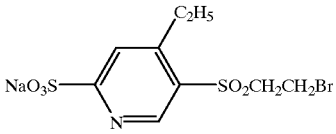
BR-107
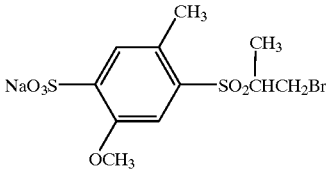
BR-108
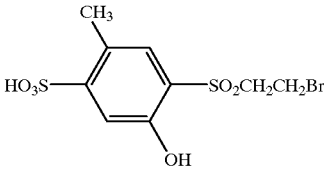
BR-109
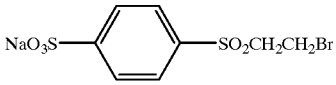
BR-110
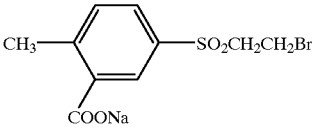
BR-111
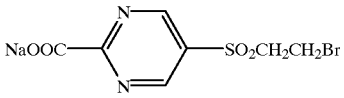
BR-112
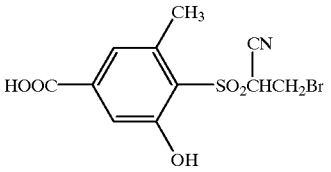
BR-113
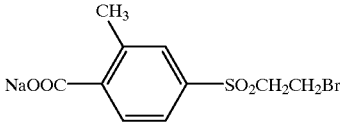
BR-114
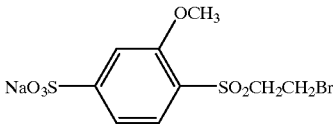
BR-115
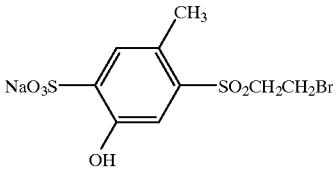

-continued
BR-116
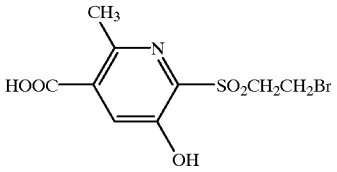
BR-117
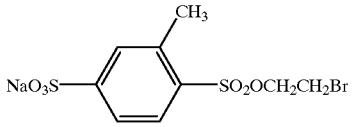
BR-118
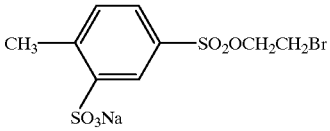
BR-119
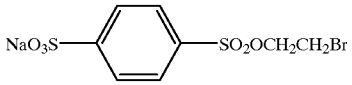
BR-120
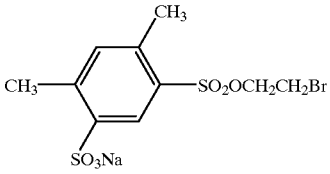
BR-121
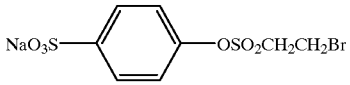
BR-122
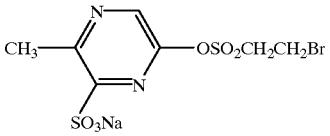
BR-123
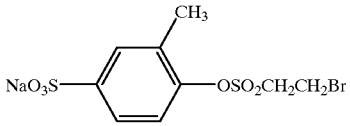
BR-124
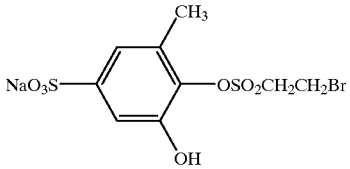
BR-125
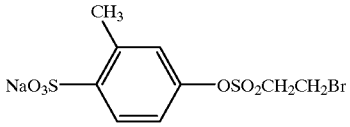
-continued
BR-126
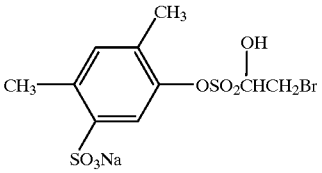
BR-127
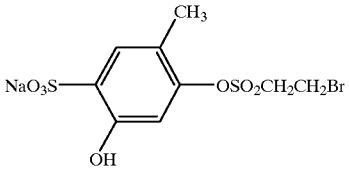
BR-128
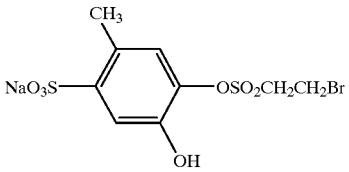
BR-129
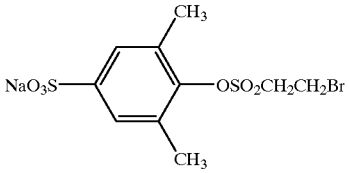
BR-130
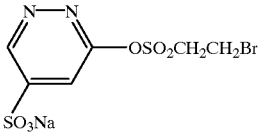
BR-131
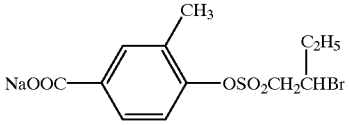
BR-132
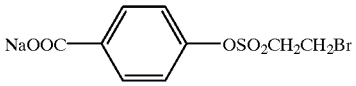
BR-133
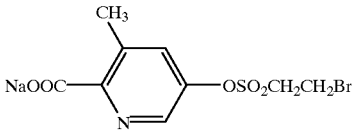
BR-134
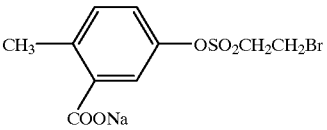

-continued
BR-135
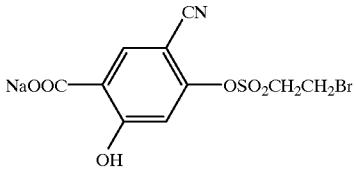
BR-136
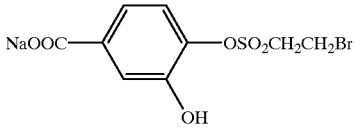
BR-137
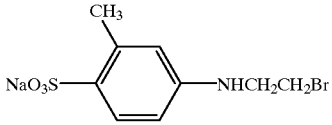
BR-138
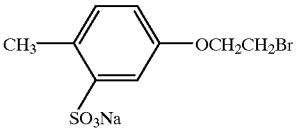
BR-139
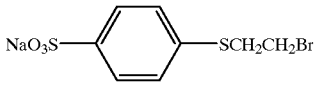
BR-140
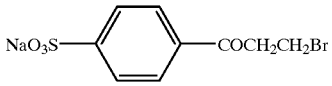
BR-141
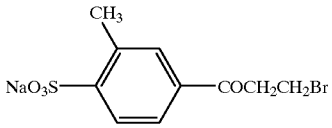
BR-142
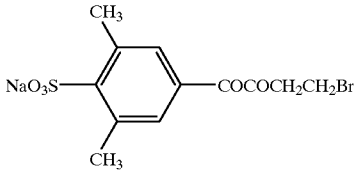
BR-143
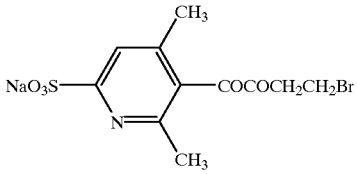
BR-144
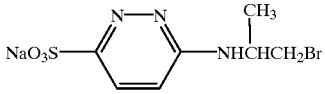
-continued
BR-145
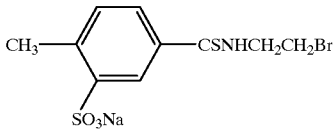
BR-146
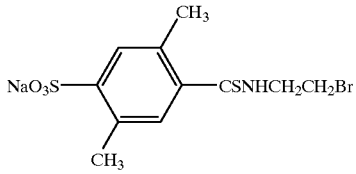
BR-147
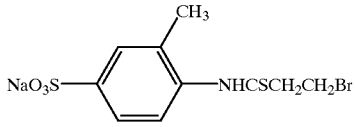
BR-148
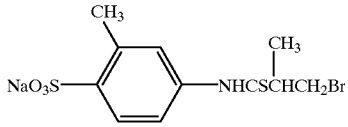
BR-149
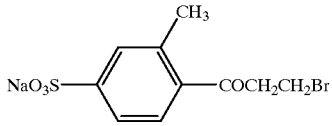
BR-150
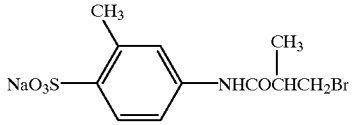
BR-151
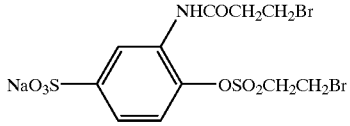
BR-152
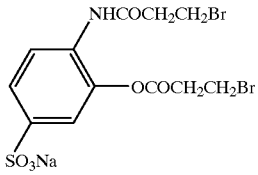
BR-153
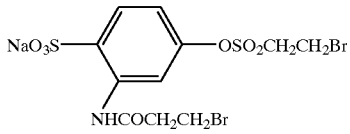
BR-154
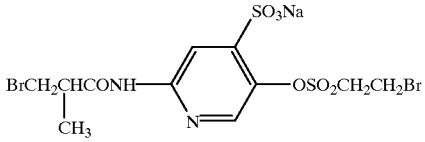

-continued

BR-155

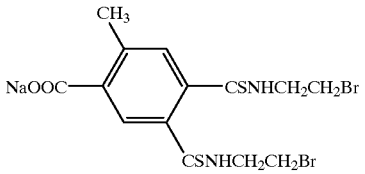

BR-156

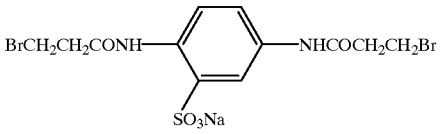

BR-157

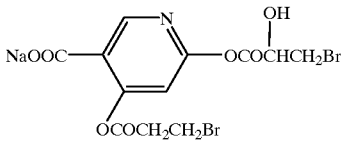

BR-158

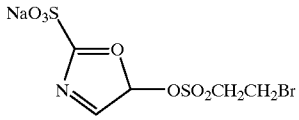

BR-159

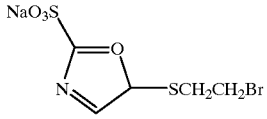

Next, representative synthesis examples will be shown below.

SYNTHESIS EXAMPLE 1

(Synthesis of Compound CL-8)

After 27.5 g of 5-aminoisophthalic acid and 40.5 g of sodium hydrogencarbonate were dissolved in 330 ml of water, 29.8 g of chloroacetylchloride was gradually and dropwise added thereto with ice-cooling. After completing addition, the mixture was allowed to react further for 30 min. and then 31 ml of concentrated hydrochloric acid was gradually and dropwise added. Precipitated crystals were filtered and dried to obtain the objective material (in a yield of 40 g). Chemical structure was confirmed through NMR spectrum, MS spectrum, IR spectrum and elemental analysis.

SYNTHESIS EXAMPLE 2

(Synthesis of Compound CL-20)

After 33 g of 2-aminoethane-1-sulfonic acid and 44.3 g of sodium hydrogencarbonate were dissolved in 390 ml of water, 50 g of p-chloromethylbenzoylchloride was gradually and dropwise added thereto at room temperature. After completing addition, the mixture was allowed to react further for 5 hr., then filtered and to the filtrate was added 40 g of sodium chloride. Precipitated crystals were filtered and recrystalized from water to obtain the objective material (in a yield of 40 g). Chemical structure was confirmed through NMR spectrum, MS spectrum, IR spectrum and elemental analysis.

SYNTHESIS EXAMPLE 3

(Synthesis of Compound CL-26)

After 52 g of sulfanilic acid and 57.5 g of sodium hydrogencarbonate were dissolved in 450 ml of water, 38.6 g of chloroacetylchloride was gradually and dropwise added thereto with ice-cooling. After completing addition, the mixture was allowed to react further for 30 min., filtered. and the filtrate was cooled. Precipitated crystals were filtered and recrystalized from water to obtain the objective material (in a yield of 65 g). Chemical structure was confirmed through NMR spectrum, MS spectrum, IR spectrum and elemental analysis.

SYNTHESIS EXAMPLE 4

(Synthesis of Compound CL-61)

After 130 g of phenolsulfonic acid was dissolved in 1000 ml of water, 140 g of sodium hydrogencarbonate was gradually added thereto. After completing addition, the mixture was cooled to 10° C. and 114 g of chloropropionic acid chloride was gradually and dropwise added thereto. After addition, the reaction mixture was heated to room temperature and further stirred for 2 hr. After adding 30 g of activated carbon and stirring, activated carbon was filtered out and the filtrate was distilled under reduced pressure. The residue was recrystalized from water to obtain the objective material in a yield of 122 g. Chemical structure was confirmed through NMR spectrum, MS spectrum, IR spectrum and elemental analysis.

SYNTHESIS EXAMPLE 5

(Synthesis of Compound CL-91)

After 131.8 g of sulfanilic acid was dissolved in 1000 ml of water, 143.2 g of sodium hydrogencarbonate was gradually added thereto. After completing addition, the mixture was cooled to 10° C. and 109 g of chloropropionic acid chloride was gradually and dropwise added thereto. After addition, the reaction mixture was heated to room temperature and further stirred for 2 hr. After adding 30 g of activated carbon and stirring, activated carbon was filtered out and the filtrate was distilled under reduced pressure. The residue was recrystalized from water to obtain the objective material in a yield of 138 g. Chemical structure was confirmed through NMR spectrum, MS spectrum, IR spectrum and elemental analysis.

SYNTHESIS EXAMPLE 6

(Synthesis of Compound CL-101)

After 50 g of β-chloroethylbenzene was dissolved in 250 ml of dichloromethane, the solution was cooled 5° C. and then 54.0 g of chlorosulfuric acid was gradually added thereto. After stirring for 2 hr., the reaction mixture was heated to room temperature and added to 500 ml of a saturated sodium chloride solution. After stirring for a while, the mixture was filtered. The filtered residue was washed with acetone and dried to obtain 62 g of β-chloroethylthiobenzene-4-sulfonic acid. In 200 ml water was dissolved 57 g of β-chloroethylthiobenzene-4-sulfonic acid, 0.74 g of $Na_2WO_4.2H_2O$ was added thereto and cooled 10° C. With maintaining the same temperature was dropwise added 79 g of hydrogen peroxide. After completing reaction, water was distilled out under reduced pressure and the residue was washed with acetone and dried to obtain 52 g of the objective material. Chemical structure was confirmed through NMR spectrum, MS spectrum, IR spectrum and elemental analysis.

SYNTHESIS EXAMPLE 7

(Synthesis of Compound BR-8)

After 27.5 g of 5-aminoisophthalic acid and 40.5 g of sodium hydrogencarbonate were dissolved in 330 ml of water, 32.8 g of bromoacetylchloride was gradually and dropwise added thereto with ice-cooling. After completing addition, the mixture was allowed to react further for 30 min. and then 31 ml of concentrated hydrochloric acid was gradually and dropwise added. Precipitated crystals were filtered and dried to obtain the objective material (in a yield of 45 g). Chemical structure was confirmed through NMR spectrum, MS spectrum, IR spectrum and elemental analysis.

SYNTHESIS EXAMPLE 8

(Synthesis of Compound BR-20)

After 33 g of 2-aminoethane-1-sulfonic acid and 44.3 g of sodium hydrogencarbonate were dissolved in 390 ml of water, 50 g of p-bromomethylbenzoylchloride was gradually and dropwise added thereto at room temperature. After completing addition, the mixture was allowed to react further for 5 hr., then filtered and to the filtrate was added 48 g of sodium chloride. Precipitated crystals were filtered and recrystalized from water to obtain the objective material (in a yield of 40 g). Chemical structure was confirmed through NMR spectrum, MS spectrum, IR spectrum and elemental analysis.

SYNTHESIS EXAMPLE 9

(Synthesis of Compound BR-61)

After 130 g of phenolsulfonic acid was dissolved in 1000 ml of water, 140 g of sodium hydrogencarbonate was gradually added thereto. After completing addition, the mixture was cooled to 10° C. and 134 g of bromopropionic acid chloride was gradually and dropwise added thereto. After addition, the reaction mixture was heated to room temperature and further stirred for 2 hr. After adding 30 g of activated carbon and stirring, activated carbon was filtered out and the filtrate was distilled under reduced pressure. The residue was recrystalized from water to obtain the objective material in a yield of 153 g. Chemical structure was confirmed through NMR spectrum, MS spectrum, IR spectrum and elemental analysis.

SYNTHESIS EXAMPLE 10

(Synthesis of Compound BR-91)

After 131.8 g of sulfanilic acid was dissolved in 1000 ml of water, 143.2 g of sodium hydrogencarbonate was gradually added thereto. After completing addition, the mixture was cooled to 10° C. and 139 g of bromopropionic acid chloride was gradually and dropwise added thereto. After addition, the reaction mixture was heated to room temperature and further stirred for 2 hr. After adding 30 g of activated carbon and stirring, activated carbon was filtered out and the filtrate was distilled under reduced pressure. The residue was recrystalized from water to obtain the objective material in a yield of 158 g. Chemical structure was confirmed through NMR spectrum, MS spectrum, IR spectrum and elemental analysis.

Silver halide grains contained in the silver halide emulsion used in the invention may have a regular crystal form such as a cubic, octahedral or tetradehedral form, or an irregular crystal form such as a spherical or tabular form. Grains having various proportions of (100) plane and (111) plane are optionally employed. Further, the composite of these crystal forms may be available and grains having various crystal forms may be mixed. Furthermore, there can be employed twinned silver halide grains having two opposite parallel twin planes, in which tabular silver halide grains are preferably used. The expression "twinned grains" refers to silver halide grains having one or more twin planes within the grain. Crystallographic classification of twinned crystal grains is detailed in Klein & Moisar, Photographishe Korrespondenz 99 99 and ibid 100 57.

Furthermore, the tabular silver halide grains preferably account for at least 50%, more preferably at least 60%, and still more preferably at least 80% of the total projected area of silver halide grains contained in the emulsion.

Silver halide grains used in the invention are comprised of tabular rains having two twin planes parallel to the major faces, the percentage of which is 50% by number or more, preferably 60% or more, more preferably 70% or more, and still more preferably 80% or more.

The tabular grains according to the invention refers to silver halide grains having an aspect ratio of 1.3 or more. The aspect ratio is preferably 3.0 to 100, and more preferably 5.0 to 50. The aspect ratio is referred to a ratio of grain diameter to grain thickness.

To determine the aspect ratio, the diameter and the thickness of silver halide grains can be measured according to the following manner. Thus, a sample is prepared by coating on a support latex balls with a known diameter as a internal standard and silver halide grains so that the major faces are oriented in parallel to the support. After being subjected to shadowing from a given direction by the carbon vapor deposition method, a replica sample is prepared by a conventional replica method. From electronmicrographs of the sample, the projected area diameter and thickness can be determined using an image processing apparatus. In this case, the silver halide grain thickness can be determined from the internal standard and the length of shadow of the grain.

The twin plane of silver halide grains can be observed with a transmission electron microscope, for example, according to the following manner. A coating sample is prepared by coating a silver halide emulsion on a support so that the major faces of tabular silver halide grains are oriented substantially in parallel to the support. The sample is sliced by a diamond cutter to obtain an approximately. 0.1 gm thick slice. The presence of the twin plane can then be observed with a transmission electron microscope.

The average diameter of the tabular silver halide grains according to the invention is preferably 0.2 to 10 am, more preferably 0.3 to 7 $\mu$m, and still more preferably 0.4 to 5.0 $\mu$m. The average diameter is defined as a diameter when product of frequency (ni) of grains having a diameter ri and $ri^3$, i.e., $ni \times ri^3$, is maximum, provided that the significant figure is three figures, the last digit is rounded off and at least 1,000 randomly selected grains, are subjected to measurement.

In the case of tabular silver halide grains, the grain diameter is the diameter of a circle having an area equivalent to the projected area when viewed from the direction perpendicular to the major faces; and in the case of silver halide grains other than the tabular grains, the grain diameter is the diameter of a circle equivalent to the grain projected area. The grain diameter (ri) can be determined viewing silver halide grains at a factor of 10,000 to 70,000 times with an electron microscope and measuring the diameter or projected area.

The silver halide emulsion used in the invention may be optionally employed, such as a polydispersed emulsion with a wide diameter distribution and a monodispersed emulsion with a narrower diameter distribution, however, the monodispersed emulsion is preferred. The monodispersed emulsion has preferably not more than 20%, and more preferably not more than 16% of the g rain diameter distribution (or a variation coefficient of grain diameter), as defined below:

Grain diameter distribution (%)=(standard deviation of grain diameter/average grain diameter)×100 where the average diameter and the standard deviation are determined from the diameter (ri) defined above.

The silver halide emulsion according to the invention maybe any one of conventionally used silver halide, such as silver iodobromide, silver iodochlorobromide or silver iodochloride, and silver godobromide or silver iodochlorobromide is preferred. The average silver iodide content of silver halide grains contained in the emulsion is preferably 1 to 40 mol %, and more preferably 2 to 20 mol %.

The average silver iodide content of a silver halide grain group c an be determined by the EPMA method (or Electron Probe Micro Analyzer method). Thus, a sample which is prepared by dispersing silver halide grains so that the grains are not in contact with each other, is exposed to electron beams while cooled with liquid nitrogen to not higher than −100° C. Characteristic X-ray intensities of silver and iodine which are radiated from individual grains are measured to determine the silver iodide content of each grain. At least 50 grains are subjected to measurement and their average value is determined.

Silver halide grains contained in the silver halide emulsion according to the invention are preferably core/shell type grains. The core/shell type grains are those comprised of a core and a shell covering the core. The shell is formed of one or more layers. Silver iodide contents of the core and the shell preferably differ from each other.

Silver halide emulsions used in the invention can be prepared by the method known in the art, including single jet precipitation, double jet precipitation, triple jet precipitation and a combination thereof, and a fine silver halide grain-supplying method. There can also be employed a method of controlling the pH and pAg in the liquid phase forming silver halide grains, in response to the growth rate of silver halide grains.

A seed grain emulsion can be employed to form the silver halide emulsion according to the invention. Silver halide grains of the seed emulsion may have a regular crystal structure such as cubic form, octahedral form and tetradecahedral form or an irregular crystal structure such as spherical or tabular form. The ratio of (100) face to (111) face of the grains is optional. The grains may be a composite of these crystal forms or a mixture of various crystal form grains. The silver halide grains of the seed emulsion are preferably twinned crystal grains having at least one twin plane, and more preferably twinned crystal grains having two parallel twin planes.

In any cases where the seed emulsion is employed or not, methods known in the art can be applied to the conditions for silver halide nucleation and ripening.

Silver halide solvents known in the art may be employed in preparation of a silver halide emulsion. Examples of the silver halide solvents include (a) organic thioethers described in U.S. Pat. Nos. 3,217,157, 3,531,289, 3,574,628 and JP-B 58-30571; (b) thiourea derivatives described in JP-A 53-82408, 55-29829 and 57-77736; (c) a silver halide solvent having a thiocarbonyl group interposing between a oxygen or sulfur atom and a nitrogen atom, described in JP-A 53-144319; (d) imidazoles described in JP-A 54-100717; (e) sulfites; (f) thiocyanates; (g) ammonia; (h) ethylendiamines substituted by a hydroxyalkyl group, described in JP-A 57-196228; (i) substituted mercaptotetrazoles described in JP-A 57-202531, (j) aqueous soluble bromides; and (k) benzimidazole derivatives described in JP-A 58-54333.

To preparation of silver halide emulsions can be applied any one of acidic precipitation, neutral precipitation and ammoniacal precipitation, and acidic or neutral precipitation is preferably employed. In the silver halide preparation, a halide ion and a silver ion may be simultaneously added, or any one of them may be added into the other one. Taking into account the critical growth rate of silver halide crystals, the halide and silver ions can be added successively or simultaneously while controlling the pAg and pH within the reaction vessel. Halide composition of silver halide grains can be varied by a halide conversion method at any stage during the course of forming silver halide grains.

Using at least one selected from a cadmium salt, a zinc salt, a lead salt, thallium salt, a iridium salt (including its complex salt), a rhodium salt (including its complex salt), a iron salt or other VIII group metal salts (including their complex salts), a metal may be added to allow the metal to be occluded (or doped) in the interior and/or exterior of silver halide grains.

In preparation of a photographic emulsion, material capable of forming protective colloid can be as a dispersing medium, and gelatin is preferably employed. Gelatin used as the dispersing medium includes an alkali processed gelatin, an acid processed gelatin, and a deionized gelatin Preparation of gelatin is described in detail in A. Veis, "The Macromolecular Chemistry of Gelatin", Academic Press, 1964. Examples of the protective colloid forming substance other than gelatin include gelatin derivatives, a graft polymer of gelatin and other polymers, proteins such as albumin or casein; cellulose derivatives such as hydroxyethyl cellulose, carboxymethyl cellulose and cellulose sulfuric acid ester; saccharide derivatives such as sodium alginate or starch derivatives; a synthetic or semi-synthetic hydrophilic polymer such as polyvinyl alcohol, polyvinyl alcohol partial acetal, poly-N-vinylpyrrolidone, polyacrylic acid, polyacrylamide, polyvinyl imidazole or polyvinyl pyrazole, including their copolymer.

The silver halide emulsion is preferably subjected to reduction sensitization using a method known in the art. The reduction sensitization may be performed during the stage of forming silver halide grains or after the grain formation. Preferred examples of the method of reduction sensitization include a method in which silver halide grains are ripened or grown at a low pAg by supplying silver ions (or so-called silver ripening), a method of ripening at a high pH by using an alkaline material and a method of adding a reducing agent. Examples of the reducing agent include thiourea dioxide, ascorbic acid or its derivative, a stannous salt, a borane compound, formamidine, sulfinic acid, silane compound, an amine or polyamine, and a sulfite. Of these, thiourea dioxide, ascorbic acid or its derivative or a stannous salt is preferably employed.

Known oxidizing agents can also be employed in the preparation of silver halide emulsions. Examples of the oxidizing agent include hydrogen peroxide (solution) or its adduct, such as $H_2O_2$, $NaBO_2$, $H_2O_2$—$3H_2O$, $2Na_2CO_3$—$3H_2O_2$, $Na_4P_2O_7$—$2\ H_2O_2$, and $2Na_2SO_4$—$H_2O_2$—$2H_2O$; peroxyacid salts such as $K_2S_2O_3$, $K_2C_2O_3$, $K_4P_2O_3$, $K_2[Ti(O)_2C_2O_4]$—$3H_2O$, peracetic acid, ozone and a thiosulfonic acid compound. The reducing agent and the oxidizing agent can be employed in combination.

The silver halide grains of the silver halide emulsion according to the invention preferably contain dislocation lines in the interior of the grain. The position of the dislocation lines is not limited, but the dislocation lines are present preferably in the vicinity of fringe portions, edges or corners of the grain. The dislocation lines are introduced into the silver halide grains preferably at not less than 50%, and more preferably not less than 60% and less than 85% of the total silver amount of silver halide grains. With respect to the number of dislocation lines, silver halide grains having 5 or more dislocation lines preferably account for at least 30%, more preferably at least 50%, and still more preferably at least 80%. The number of dislocation lines per grain is preferably not less than 10, more preferably not less than 20, and still more preferably not less than 30.

The dislocation lines of silver halide grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that may cause dislocation in the grains, and they are than placed on a mesh for electron microscopy. The sample is observed by transmission electron microscopy, while being cooled to prevent the grain from being damaged by electron beam (e.g., printing-out). Since electron beam penetration is hampered as the grain thickness increases, sharper observations are obtained when using a high voltage type electron microscope. From the thus-obtained electron micrograph can be determined the position and number of the dislocation lines in each grain.

A method for introducing the dislocation lines into the silver halide grain is optional. The dislocation lines can be introduced by various methods, in which, at a desired position of introducing the dislocation lines during the course of forming silver halide grains, an iodide (e.g., potassium iodide) aqueous solution is added, along with a silver salt (e.g., silver nitrate) solution and without addition of a halide other than iodide by a double jet technique, silver iodide fine grains are added, only an iodide solution is added, or a compound capable of releasing an iodide ion disclosed in JP-A 6-11781 (1994) is employed.

Silver halide grains can also be prepared by supplying fine silver halide grains. In cases where fine silver halide grains are employed in the invention, the fine silver halide grains may be prepared prior to or concurrently to the preparation of the silver halide emulsion according to the invention. When concurrently prepared, as described in JP-A 1-183417 and 2-44335, the fine silver halide grains can be prepared in a mixing vessel provided outside a reaction vessel in which silver halide emulsion relating to the invention is prepared. In this case, it is preferred that a preparation vessel is provided separately from the mixing vessel, a preparation vessel is provided, in which fine silver halide grains prepared in the mixing vessel is optimally prepared so as to be suitable for growth environment in the reaction vessel and then supplied to reaction vessel.

The fine silver halide grains are preferably prepared preferably under an acidic or neutral environment (pH≦7). The fine silver halide grains can be prepared by mixing a silver ion containing aqueous solution and a halide ion containing aqueous solution while optimally controlling supersaturation parameter(s). The control of the supersaturation parameter is referred to the description in JP-A 63-92942 and 63-311244. To prevent production of reduced silver nuclei, the fine silver halide grains are prepared preferably at a pAg of not less than 3.0, more preferably not less than 5.0, and still more preferably not less than 8.0. The fine silver halide grains are prepared preferably at a temperature of 50° C. or less, more preferably 40° C. or less, and still more preferably 35° C. or less. As a protective colloid used in the preparation of the fine silver halide grains can be employed the aforementioned protective colloid forming substances used in the preparation of the silver halide emulsion according to the invention. In the case when the fine silver halide grains are prepared at a low temperature, a grain size increase due to Ostwald ripening can be prevented but gelatin is liable to gel at a low temperature, so that a low molecular weight gelatin described in JP-A 2-166422 a synthetic polymer compound or a natural polymer compound other than gelatin, which has protective colloidal action onto silver halide grains, is preferably employed. The concentration of the protective colloid is preferably not less than 1% by weight, more preferably not less than 2%, and still more preferably 3%. The diameter of the fine silver halide grains is preferably not more than 0.1 μm, and more preferably not more than 0.05 μm. The fine silver halide grains may optionally be subjected to reduction sensitization or doped with a metal ion.

During or after forming silver halide grains, it is preferred to perform desalting to prevent physical ripening or remove unnecessary salts. Desalting can be carried out, for example, according to the method described in Research Disclosure (hereinafter, also denoted as "RD") 17643 Sect. II. Thus, a noodle washing method by gelling gelatin or a flocculation method by the use of an inorganic salt, an anionic surfactant, an anionic polymer (e.g., polystyrene sulfonic acid) or a gelatin derivative (e.g., acylated gelatin, carbamoyled gelatin) is preferably employed to remove unnecessary salts from precipitates or a physical-ripened emulsion. Desalting by employing membrane separation, as described in Kagaku Kogaku Binran (Handbook of Chemical Engineering) 5th Edition, page 924–954, edited by Kagakukogaku Kyokai and published by Maruzen. The membrane separation method can further be referred to RD 10208 and 13122; JP-B 59-43727 and 62-27008; JP-A57-209823, 59-43727, 61-219948, 62-2303562-113137, 63-40039, 63-40137, 2-172816, 2-172817, 3-140946 and 4-22942. Conditions other than those described above can be optimally selected by reference to JP-A 61-6643, 61-14630, 61-112142, 62-157024, 62-18556, 63-92942, 63-151618, 63-163451, 63-220238 and 63-311244; RD 36736 and 39121.

A silver halide emulsion, which has been subjected to physical ripening, chemical sensitization and spectral sensitization, is employed to prepare the silver halide light sensitive photographic material according to the invention. Additives used in these processes are described in RD 17643 page 23 Sect.III to page 24 Sect.VI-M, RD 18716 page 648–649, and RD 308119 page 996 Sect.III to page 1000 Sect.VI-M.

Known photographic additives used in the invention are described in RD 17643 page 25 Sect. VIII-A to page 27 Sect.XIII, RD 18716 page 650–651, and RD 308119 page 1003 Sect.VIII to page 1012 Sect.XXI-E.

In color photographic materials can be employed a variety of couplers. Examples thereof are described in RD 17643 page 25 Sect.VII-C to G and RD 308119 page 1001 Sect.VII-C to G.

The additives used in the invention can be added by the dispersing method described in RD 308119 XIV. There are employed supports described in RD 17643 page 28, RD 18716 pages 647–8 and RD 308119 XIX. The photographic material relating to the invention may be provided with an auxiliary layer such as a filter layer or interlayer. as described in RD 308119 VII-K, and may have a layer arrangement, such as normal layer order, reversed layer order or unit constitution.

The present invention can be applied to a variety of color photographic materials, including a color negative film for general use or cine use, color reversal film for slide or television, color paper, color positive film, and color reversal paper.

The photographic material relating to the invention can be processed in accordance with conventional methods, as described in RD 17643 pages 28–29 Sect.XIX, RD 18716 page 651, and RD 308119 page 1010-1011 Sect.XIX.

EXAMPLES

The present invention will be further explained based on examples, but embodiments of the present invention are by no means limited to these examples.

EXAMPLE 1

Preparation of Seed Emulsion T-1

A seed grain emulsion (T-1) having two parallel twin planes was prepared according the following procedure.

| | |
|---|---|
| A-1 Solution | |
| Ossein gelatin | 38.0 g |
| Potassium bromide | 11.7 g |
| Water to make | 34.0 lit. |
| B-1 Solution | |
| Silver nitrate | 810.0 g |
| Water to make | 3815 ml |
| C-1 Solution | |
| Potassium bromide | 567.3 g |
| Water to make | 3815 ml |
| D-1 Solution | |
| Ossein gelatin | 163.4 g |
| 10% Surfactant (EO-1) methanol solution | 5.5 ml |
| Water to make | 3961 ml |
| E-1 Solution | |
| Sulfuric acid (10%) | 91.1 ml |
| F-1 Solution | |
| Aqueous 56% acetic acid solution | Necessary amount |
| G-1 Solution | |
| Ammoniacal water (28%) | 105.7 ml |
| H-1 Solution | |
| Aqueous potassium hydroxide solution | Necessary amount |

EO-1: $HO[(CH_2CH_2O)m(CH(CH_3)CH_2O]_{19.8}(CH_2CH_2O)nH$ (m + n = 9.77)

To solution A-1 with vigorously stirring at 30° C. by the use of a stirrer described in JP-A 62-160128 was added solution E-1 and then, solutions B-1 and C-1, each 279 ml, were added by the double jet addition at a constant flow rate for a period of 1 min. to form silver halide nucleus grains. Subsequently, solution D-1 was added thereto and after the temperature was raised to 60° C. in 31 min., solution G-1 was further added, and after adjusting the pH to 9.3 with solution H-1, ripening was carried out for 6.5 min. Then after the pH was adjusted to 5.8 with solution F-1, residual B-1 and C-1 solution were added by the double jet method for a period of 37 min. and the emulsion was immediately desalted. From electron microscopic observation of the resulting seed emulsion, it was proved that the emulsion was comprised of imonodispersed silver halide seed grains having two parallel twin planes, an average grain diameter (equivalent circle diameter) of 0.72 μm and a grain diameter distribution of 16%. Preparation of Comparative Emulsion Em-1 Using the following solutions was prepared a comparative emulsion (Em-1).

| | |
|---|---|
| A-2 Solution | |
| Ossein gelatin | 519.9 g |
| 10% Surfactant (EO-1) methanol solution | 4.5 ml |
| Seed emulsion (T-1) | 5.3 mol equivalent |
| Water to make | 18.0 lit. |
| B-2 Solution | |
| 3.5N Silver nitrate aqueous solution | 2787 ml |
| C-2 Solution | |
| Potassium bromide | 1020 g |
| Potassium iodide | 29.1 g |
| Water to make | 2500 ml |
| D-2 Solution | |
| Potassium bromide | 618.5 g |
| Potassium iodide | 8.7 g |
| Water to make | 1500 ml |
| E-2 | |
| Potassium bromide | 208.3 g |
| Water to make | 1000 ml |
| F-2 Solution | |
| 56 wt. % acetic acid aqueous solution | Necessary amount |
| H-2 Solution | |
| Fine grain emulsion* comprised of 3.0 wt. % gelatin and fine silver iodide grains (average diameter of 0.05 μm) | 0.672 mol equivalent |
| K-2 Solution | |
| Aqueous 10% potassium hydroxide solution | Necessary amount |

*Preparation
To 9942 ml of a 5.0 wt. % gelatin aqueous solution containing 0.254 mol potassium iodide was added 3092 ml of an aqueous solution containing 10.59 mol silver nitrate and 3092 ml of an aqueous solution containing 10.59 mol potassium iodide at a constant flow rate for 35 min. During addition, the temperature was maintained at 40° C., and the pH and EAg were not specifically controlled.

To a reaction vessel was added solution A-2 and solutions B-2, C-2 and D-2 were added with vigorously stirring at 75° C. by the double jet addition, as shown in Table 1, so *I that the seed grains were allowed to grow to prepare a comparative silver halide grain emulsion Em-1. Herein, taking into account a critical growth rate, solutions B-2, C-2 and D-2 were added at an accelerated flow rate so that production of fine grains other than growing seed grains and widening of grain diameter distribution due to Ostwald ripening between growing grains did not occur. Grain growth was performed in a manner such that the first addition was conducted, while the temperature, pAg and pH of a solution within a reaction vessel were controlled at 75° C., 8.9 and 5.8, respectively. In the first addition, 65.8% of solution B-2 was added. Thereafter, the temperature was raised to 60° C. in 15 min., solution H-2 was added at a constant flow rate for a period of 2 min. and then the second addition was conducted while controlled at a temperature of 60° C., a pAg of 9.4 and a pH of 5.0, in which residual B-2 was added. The pAg and pH were each controlled by adding solutions E-2, F-2 and K-2. after completing grain formation, the emulsion was desalted according to the procedure described in JP-A 5-72658 and redispersed by adding gelatin thereto to obtain an emulsion with a pAg of 8.06 and a pH of 5.8. From electron microscopic observation of silver halide emulsion grains, it was proved that the resulting emulsion was comprised of monodispersed, hexagonal tabular silver halide grains having an average diameter of 1.65 μm, a grain diameter distribution of 16% and an average aspect ratio of 8.5. Further, dislocation lines formed on silver halide grains were observed using a transmission electron microscope. As a result, it was proved that at least 90% by number of total grains was accounted for by grains containing 15 or more dislocation lines per grain. The dislocation lines were formed mainly fringe portions of tabular grains.

TABLE 1

| Added solution | Add. time (min) | Added silver amount (%) | Iodide content* (mol %) | Remark |
|---|---|---|---|---|
| B-2 | 0.00 | 0.0 | 2.0 | 1st |
| C-2 | 5.26 | 11.7 | 2.0 | Addition |
| | 8.63 | 21.2 | 2.0 | |
| | 12.65 | 34.8 | 2.0 | |
| | 12.81 | 47.3 | 2.0 | |
| | 19.85 | 65.8 | 2.0 | 2nd |
| B-2 | 0.00 | 65.8 | 1.0 | Addition |
| D-2 | 6.23 | 73.8 | 1.0 | |
| | 12.62 | 82.5 | 1.0 | |
| | 18.67 | 91.1 | 1.0 | |
| | 24.42 | 100.0 | 1.0 | |

*An iodide content of an added halide solution

Preparation of Inventive Emulsion Em-2

Emulsion Em-2 according to the invention was prepared in a manner similar to emulsion Em-1, except that solution X as below was added immediately before adding solutions B-2 and C-2; solution Y as below was added immediately before adding solution D-1; compound CL-61 was added, before adding solution H-2, in the form of a 10% aqueous solution, in an amount of 3.0 mol %, based on total silver halide; the pH was raised to 9.5 and after maintained for 5 min., the pH was lowered to 5.0.

| | |
|---|---|
| X Solution | |
| An aqueous solution containing $1.57 \times 10^{-4}$ mol/l of thiourea dioxide | 100 ml |
| Y Solution | |
| An aqueous solution containing $3.14 \times 10^{-3}$ mol/l of sodium ethylthiosulfonate | 100 ml |

Preparation of Inventive Emulsion Em-3

Emulsion Em-3 according to the invention was prepared in a manner similar to emulsion Em-1, except that solution X as described above was added immediately before adding solutions B-2 and C-2; solution Y described above was added immediately before adding solution D-1; compound CL-94 was added, before adding solution H-2, in the form of a 10% aqueous solution, in an amount of 3.0 mol %, based on total silver halide; the pH was raised to 9.5 and after maintained for 5 min., the pH was lowered to 5.0.

Preparation of Inventive Emulsion Em-4

Emulsion Em-2 according to the invention was prepared in a manner similar to emulsion Em-1, except that solution X as described above was added immediately before adding solutions B-2 and C-2; solution Y as described above was added immediately before adding solution D-1; compound CL-91 was added, before adding solution H-2, in the form of a 10% aqueous solution, in an amount of 3.0 mol %, based on total silver halide; the pH was raised to 9.5 and after maintained for 5 min., the pH was lowered to 5.0.

Preparation of Inventive Emulsion Em-5

Emulsion Em-2 according to the invention was prepared in a manner similar to emulsion Em-1, except that solution X as described above was added immediately before adding solutions B-2 and C-2; solution Y as described above was added immediately before adding solution D-1; compound CL-109 was added, before adding solution H-2, in the form of a 10% aqueous solution, in an amount of 3.0 mol %, based on total silver halide; the pH was raised to 9.5 and after maintained for 5 min., the pH was lowered to 5.0.

In the 10th layer of the following sample formula was used each of emulsions Em-1 to Em-5, which was denoted as "Silver iodobromide emulsion g". Emulsions Em-1 to Em-5 were each optimally spectrally and chemically sensitized as described below.

Preparation of Color Photographic Material

On a triacetyl cellulose film support were formed the following layers containing composition as shown below to prepare a multi-layered color photographic material Samples 101 to 105. The addition amount of each compound was represented in term of g/m$^2$, provided that the amount of silver halide or colloidal silver was converted to the silver amount and the amount of a sensitizing dye was represented in mol/Ag mol.

| | |
|---|---|
| 1st Layer: Anti-Halation Layer | |
| Black colloidal silver | 0.16 |
| UV absorbent (UV-1) | 0.3 |
| Colored magenta coupler (CM-1) | 0.123 |
| Colored cyan coupler (CC-1) | 0.044 |
| High boiling solvent (OIL-1) | 0.167 |
| Gelatin | 1.33 |
| 2nd Layer: Intermediate Layer | |
| Anti-staining agent (AS-1) | 0.16 |
| High boiling solvent (OIL-1) | 0.20 |
| Gelatin | 0.69 |
| 3rd Layer: Low-speed Red-Sensitive Layer | |
| Silver iodobromide emulsion a | 0.12 |
| Silver iodobromide emulsion b | 0.29 |
| Sensitizing dye (SD-1) | $2.37 \times 10^{-5}$ |
| Sensitizing dye (SD-2) | $1.2 \times 10^{-4}$ |
| Sensitizing dye (SD-3) | $2.4 \times 10^{-4}$ |
| Sensitizing dye (SD-4) | $2.4 \times 10^{-6}$ |
| Cyan coupler (C-1) | 0.32 |
| Colored cyan coupler (CC-1) | 0.038 |
| High boiling solvent (OIL-2) | 0.28 |
| Anti-staining agent (AS-2) | 0.002 |
| Gelatin | 0.73 |
| 4th Layer: Medium-speed Red-sensitive Layer | |
| Silver iodobromide emulsion c | 0.10 |
| Silver iodobromide emulsion d | 0.86 |
| Sensitizing dye (SD-1) | $4.5 \times 10^{-5}$ |
| Sensitizing dye (SD-2) | $2.3 \times 10^{-4}$ |
| Sensitizing dye (SD-3) | $4.5 \times 10^{-4}$ |
| Cyan coupler (C-2) | 0.52 |
| Colored cyan coupler (CC-1) | 0.06 |
| DIR compound (DI-1) | 0.047 |
| High boiling solvent (OIL-2) | 0.46 |
| Anti-staining agent (AS-2) | 0.004 |
| Gelatin | 1.30 |
| 5th Layer: High-speed Red-Sensitive Layer | |
| Silver iodobromide emulsion c | 0.13 |
| Silver iodobromide emulsion d | 1.18 |
| Sensitizing dye (SD-1) | $3.0 \times 10^{-5}$ |
| Sensitizing dye (SD-2) | $1.5 \times 10^{-4}$ |
| Sensitizing dye (SD-3) | $3.0 \times 10^{-4}$ |
| Cyan coupler (C-2) | 0.047 |
| Cyan coupler (C-3) | 0.09 |
| Colored cyan coupler (CC-1) | 0.036 |
| DIR compound (DI-1) | 0.024 |
| High boiling solvent (OIL-2) | 0.27 |
| Anti-staining agent (AS-2) | 0.006 |
| Gelatin | 1.28 |

-continued

| | |
|---|---|
| 6th Layer: Intermediate Layer | |
| High boiling solvent (OIL-1) | 0.29 |
| Anti-staining agent (AS-1) | 0.23 |
| Gelatin | 1.00 |
| 7th Layer: Low-speed Green-Sensitive Layer | |
| Silver iodobromide emulsion a | 0.19 |
| Silver iodobromide emulsion b | 0.062 |
| Sensitizing dye (SD-4) | $3.6 \times 10^{-4}$ |
| Sensitizing dye (SD-5) | $3.6 \times 10^{-4}$ |
| Magenta coupler (M-1) | 0.18 |
| Colored magenta coupler (CM-1) | 0.033 |
| High boiling solvent (IL-1) | 0.22 |
| Anti-staining agent (AS-2) | 0.002 |
| Anti-staining agent (AS-3) | 0.05 |
| Gelatin | 0.61 |
| 8th layer: Interlayer | |
| High boiling solvent (OIL-1) | 0.26 |
| Anti-staining agent (AS-1) | 0.054 |
| Gelatin | 0.80 |
| 9th Layer: Medium-speed Green-Sensitive Layer | |
| Silver iodobromide emulsion e | 0.54 |
| Silver iodobromide emulsion f | 0.54 |
| Sensitizing dye (SD-6) | $3.7 \times 10^{-4}$ |
| Sensitizing dye (SD-7) | $7.4 \times 10^{-5}$ |
| Sensitizing dye (SD-8) | $5.0 \times 10^{-5}$ |
| Magenta coupler (M-1) | 0.17 |
| Magenta coupler (M-2) | 0.33 |
| Colored cyan couple (CM-1) | 0.024 |
| Colored magenta coupler (CM-2) | 0.029 |
| DIR compound (DI-2) | 0.024 |
| DIR compound (DI-3) | 0.005 |
| High boiling solvent (OIL-1) | 0.73 |
| Anti-staining agent (AS-2) | 0.003 |
| Anti-staining agent (AS-3) | 0.035 |
| Gelatin | 1.80 |
| 10th Layer: High-speed Green-Sensitive Layer | |
| Silver iodobromide emulsion g | 1.19 |
| Sensitizing dye (SD-6) | $4.0 \times 10^{-4}$ |
| Sensitizing dye (SD-7) | $8.0 \times 10^{-5}$ |
| Sensitizing dye (SD-8) | $5.0 \times 10^{-5}$ |
| Magenta coupler (M-1) | 0.065 |
| Colored magenta coupler (CM-1) | 0.022 |
| Colored magenta coupler (CM-2) | 0.026 |
| DIR compound (DI-2) | 0.003 |
| DIR compound (DI-3) | 0.003 |
| High boiling solvent (OIL-1) | 0.19 |
| High boiling solvent (OIL-2) | 0.43 |
| Anti-staining agent (AS-2) | 0.014 |
| Anti-staining agent (AS-3) | 0.017 |
| Gelatin | 1.23 |
| 11th Layer: Yellow Filter Layer | |
| Yellow colloidal silver | 0.05 |
| High boiling solvent (OIL-1) | 0.18 |
| Anti-staining agent (AS-1) | 0.16 |
| Gelatin | 1.00 |
| 12th Layer: Low-speed Blue-sensitive Layer | |
| Silver iodobromide emulsion a | 0.08 |
| Silver iodobromide emulsion b | 0.22 |
| Sensitizing dye (SD-9) | $6.5 \times 10^{-4}$ |
| Sensitizing dye (SD-10) | $2.5 \times 10^{-4}$ |
| Yellow coupler (Y-1) | 0.77 |
| DIR compound (DI-4) | 0.017 |
| High boiling solvent (OIL-1) | 0.31 |
| Anti-staining agent (AS-2) | 0.002 |
| Gelatin | 1.29 |
| 13th Layer: High-sped Blue-sensitive Layer | |
| Silver iodobromide emulsion h | 0.41 |
| Silver iodobromide emulsion i | 0.61 |
| Sensitizing dye (SD-9) | $4.4 \times 10^{-4}$ |
| Sensitizing dye (SD-10) | $1.5 \times 10^{-4}$ |
| Yellow coupler (Y-1) | 0.23 |

-continued

| | |
|---|---|
| High boiling solvent (OIL-1) | 0.10 |
| Anti-staining agent (AS-2) | 0.004 |
| Gelatin | 1.20 |
| 14th Layer: First Protective Layer | |
| Silver iodobromide emulsion j | 0.30 |
| UV absorbent (UV-1) | 0.055 |
| UV absorbent (UV-2) | 0.110 |
| High boiling solvent (OIL-2) | 0.30 |
| Gelatin | 1.32 |
| 15th Layer: Second protective Layer | |
| Polymer PM-1 | 0.15 |
| Polymer PM-2 | 0.04 |
| Lubricant (WAX-1) | 0.02 |
| Dye (D-1) | 0.001 |
| Gelatin | 0.55 |

Characteristics of silver iodobromide emulsions described above are shown below, in which the average grain size refers to an edge length of a cube having the same volume as that of the grain.

| Emulsion | Av. grain size ($\mu$m) | Av. AgI content (mol %) | Diameter/thickness ratio |
|---|---|---|---|
| a | 0.30 | 2.0 | 1.0 |
| b | 0.40 | 8.0 | 1.4 |
| c | 0.60 | 7.0 | 3.1 |
| d | 0.74 | 7.0 | 5.0 |
| e | 0.60 | 7.0 | 4.1 |
| f | 0.65 | 8.7 | 6.5 |
| h | 0.65 | 8.0 | 1.4 |
| i | 1.00 | 8.0 | 2.0 |
| j | 0.05 | 2.0 | 1.0 |

Of the emulsions described above, for example, emulsions d and f were prepared according to the following procedure described below. Emulsion j was prepared by reference to JP-A 1-183417, 1-183644, 1-183645 and 2-166442.

Preparation of Seed Emulsion-1

To Solution A1 maintained at 35° C. and stirred with a mixing stirrer described in JP-B 58-58288 and 58-58289 were added an aqueous silver nitrate solution (1.161 mol) and an aqueous potassium bromide and potassium iodide mixture solution (containing 2 mol % potassium iodide) by the double jet method in 2 min., while keeping the silver potential at 0 mV (measured with a silver electrode and a saturated silver—silver chloride electrode as a reference electrode), to form nucleus grains. Then the temperature was raised to 60° C. in 60 min. and after the pH was adjusted to 5.0 with an aqueous sodium carbonate solution, an aqueous silver nitrate solution (5.902 mol) and an aqueous potassium bromide and potassium iodide mixture solution (containing 2 mol % potassium iodide) were added by the double jet method in 42 minutes, while keeping the silver potential at 9 mV. After completing the addition, the temperature was lowered to 40° C. and the emulsion was desalted according to the conventional flocculation washing. The obtained seed emulsion was comprised of grains having an average equivalent sphere diameter of 0.24 $\mu$m and an average aspect ratio of 4.8. At least 90% of the total grain projected area was accounted for by hexagonal tabular grains having the maximum edge ratio of 1.0 to 2.0. This emulsion was denoted as Seed Emulsion-1

| Solution A | |
|---|---|
| Ossein gelatin | 24.2 g |
| Potassium bromide | 10.8 g |
| 10% Surfactant (EO-1) ethanol solution | 6.78 ml |
| 10% Nitrate | 114 ml |
| Distilled water to make | 9657 ml |

Preparation of Fine Silver Iodide Grain Emulsion SMC-1

To 5 liters of a 6.0 wt. % gelatin solution containing 0.06 mol of potassium iodide, an aqueous solution containing 7.06 mol of silver nitrate and an aqueous solution containing 7.06 mol of potassium iodide, 2 liters of each were added over a period of 10 min., while the pH was maintained at 2.0 using nitric acid and the temperature was maintained at 40° C. After completion of grain formation, the pH was adjusted to 6.0 using a sodium carbonate aqueous solution. The resulting emulsion was comprised of fine silver iodide grains having an average diameter of 0.05 μm, and was denoted as SMC-1.

Preparation of Silver Iodobromide Emulsion d 700 ml of an aqueous 4.5 wt. % inert gelatin solution containing 0.178 mol equivalent of Seed Emulsion-1 and 0.5 ml of a 10% surfactant (SU-1) ethanol solution was maintained at 75° C. and after adjusting the pAg and pH to 8.3 and 5.0, respectively, a silver halide emulsion was prepared while vigorously stirring, according to the following procedure.

1) An aqueous silver nitrate solution of 3.093 mol, SMC-1 of 0.287 mol and an aqueous potassium bromide solution were added by the double jet method while keeping the pAg and pH were maintained at 8.4 and 5.0, respectively.

2) Subsequently, the temperature was lowered to 60° C. and the pAg was adjusted to 9.8. Then, SMC-1 of 0.071 mol was added and ripened for 2 min (introduction of dislocation lines).

3) Further, an aqueous silver nitrate solution of 0.959 mol, SMC-1 of 0.030 mol and an aqueous potassium bromide solution were added by the double jet method while keeping the pAg and pH were maintained at 9.8 and 5.0, respectively.

During the grain formation, each of the solutions was added at an optimal flow rate so as not to cause nucleation or Ostwald ripening. After completing the addition, the emulsion desalted at 40° C. by the conventional flocculation method, gelatin was added thereto and the emulsion was redispersed and adjusted to a pAg of 8.1 and a pH of 5.8. The resulting emulsion was comprised of tabular grains having an average size (an edge length of a cube with an equivalent volume) of 0.75 μm, average aspect ratio of 5.0 and exhibiting the iodide content from the grain interior of 2/8.5/X/3 mol %, in which X represents the dislocation line-introducing position. From electron microscopic observation, it was proved that at least 60% of the total grain projected area was accounted for by grains having 5 or more dislocation lines both in fringe portions and in the interior of the grain. The silver iodide content of the surface was 6.7 mol %.

Preparation of Silver Iodobromide Emulsion f

Silver iodobromide emulsion f was prepared in the same manner as emulsion d, except that in the step 1), the pAg, the amount of silver nitrate to be added and the SMC-1 amount were varied to 8.8, 2.077 mol and 0.218 mol, respectively; and in the step 3), the amounts of silver nitrate and SMC-1 were varied to 0.91 mol and 0.079 mol, respectively. The resulting emulsion was comprised of tabular grains having an average size (an edge length of a cube with an equivalent volume) of 0.65 μm, average aspect ratio of 6.5 and exhibiting the iodide content from the grain interior of 2/9.5/X/8 mol %, in which X represents the dislocation line-introducing position. From electron microscopic observation, it was proved that at least 60% of the total grain projected area was accounted for by grains having 5 or more dislocation lines both in fringe portions and in the interior of the grain. The silver iodide content of the surface was 11.9 mol %.

The thus prepared emulsions d and f were added with sensitizing dyes afore-described and ripened, and then chemically sensitized by adding triphenylphosphine selenide, sodium thiosulfate, chloroauric acid and potassium thiocyanate until relationship between sensitivity and fog reached an optimum point. Silver iodobromide emulsions a, b, c, g, h, and i were each spectrally and chemically sensitized in a manner similar to silver iodobromide emulsions d and f.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

Chemical formulas of compounds used in the Samples described above are shown below.

SU-1: $C_8F_{17}SO_2N(C_3H_7)CH_2COOK$

SU-2: $C_8F_{17}SO_2NH(CH_2)_3N^+(CH_3)_3Br^-$

Su-3: Sodium di-(2-ethylhexyl) sulfosuccinate

SU-4: Tri-i-propylnaphthalenesulfonic acid sodium salt

ST-1: 4-hydroxy-6-methyl-1,3,3a,7-tetraazaindene

ST-2: Adenine

AF-3: 1-Phenyl-5-mercaptotetrazole

AF-4: 1-(4-Carboxyphenyl)-5-mercaptotetrazole

AF-5: 1-(3-Acetoamidophenyl)-5-mercaptotetrazole

H-1: $[CH_2{=}CHSO_2CH_2)_3CCH_2SO_2CH_2CH_2]_2NCH_2CH_2SO_3K$

H-2: 2,4-Dichloro-6-hydroxy-s-triazine sodium salt

OIL-1: Tricresyl phosphate

OIL-2: Di(2-ethylhexyl)phthalate

AS-1: 2,5-Bis(1,1-dimethyl-4-hexyloxycarbonylbutyl)-hydroquinone

As-2: Dodecyl gallate

AS-3: 1,4-Bis(2-tetradecyloxycarbonylethyl)piperazine

C-1
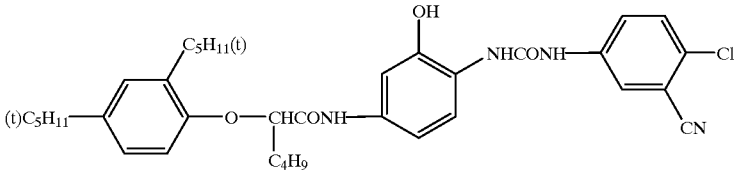
C-2
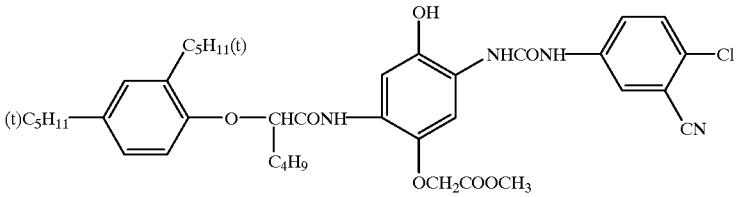
C-3
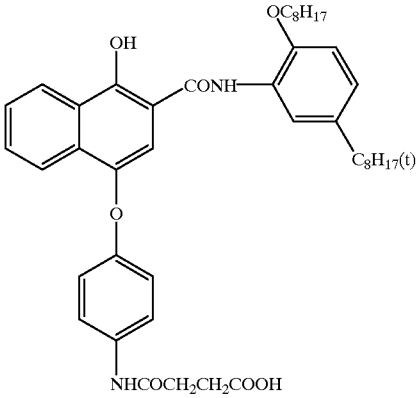
M-1
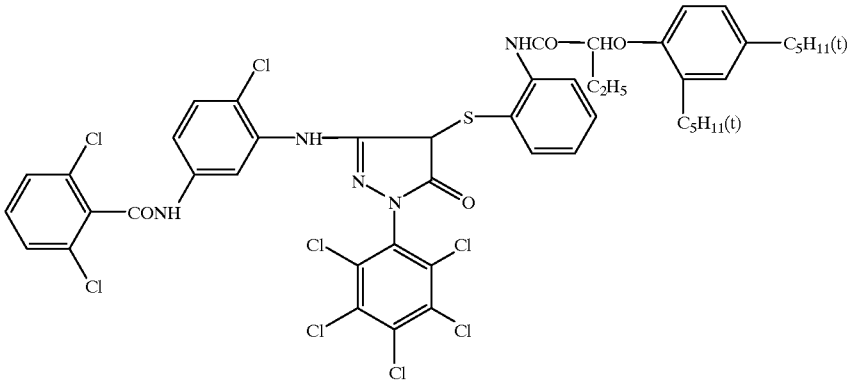
M-2
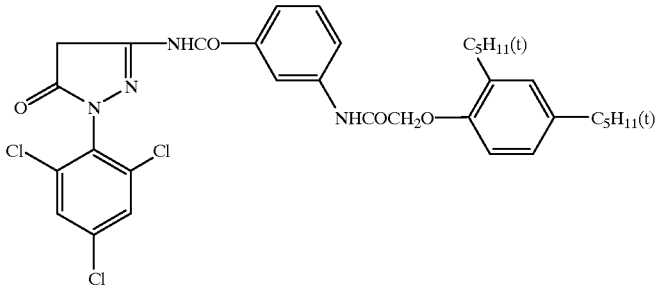

-continued
Y-1
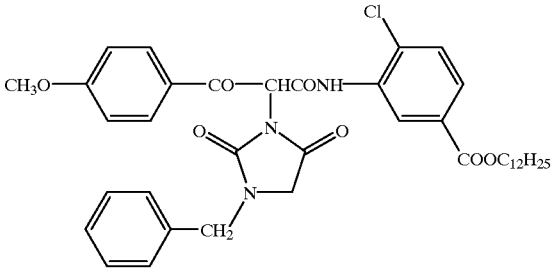
CC-1
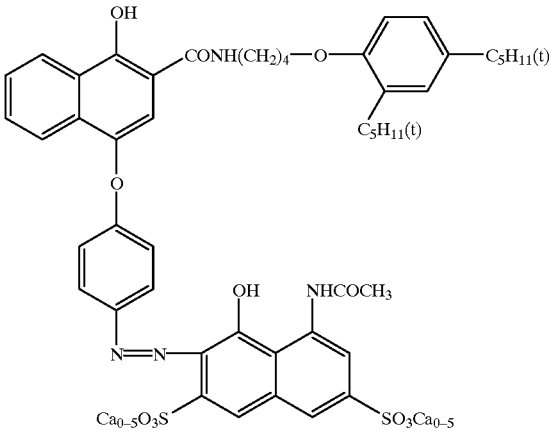
CM-1
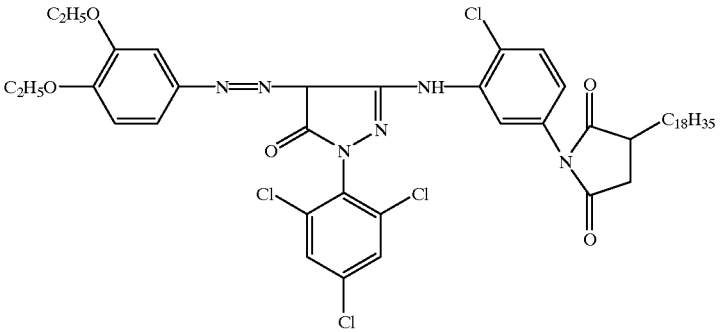
CM-2
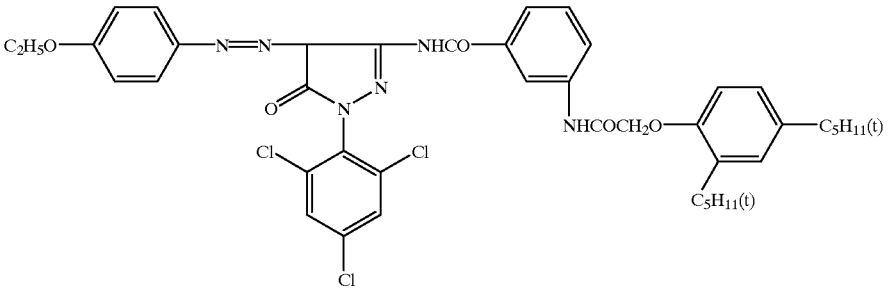

-continued
Dl-1
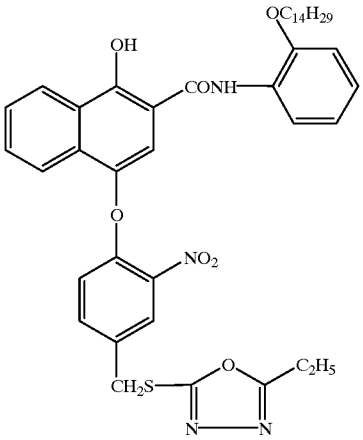
Dl-2
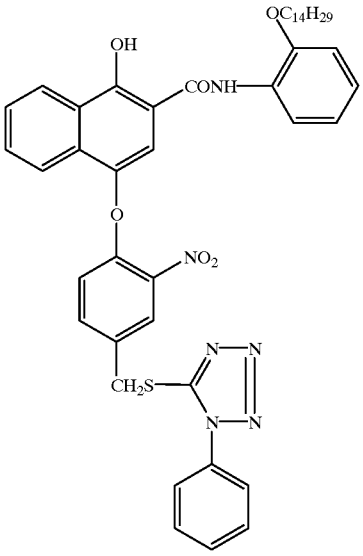
Dl-3
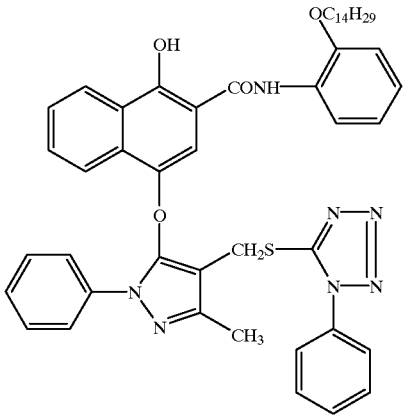

-continued
Dl-4
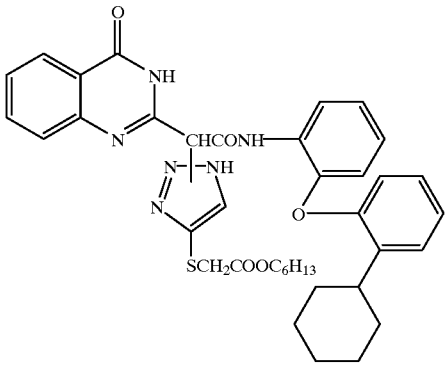
SD-1
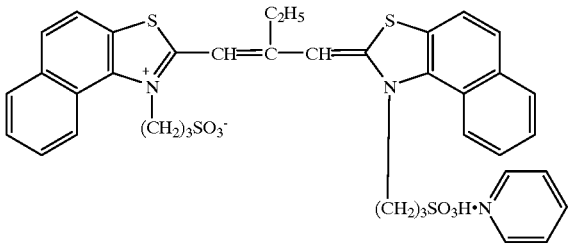
SD-2
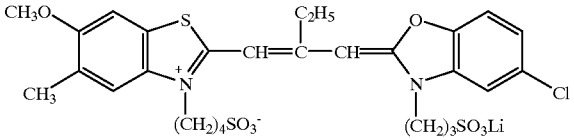
SD-3
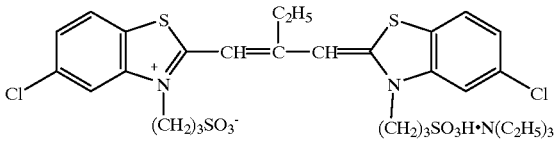
SD-4
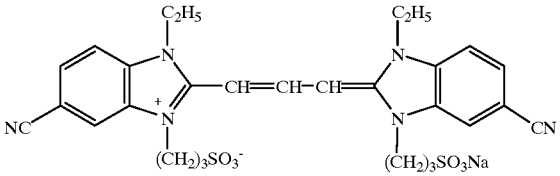
SD-5
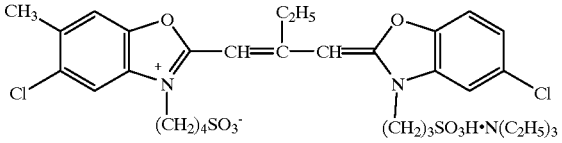
SD-6
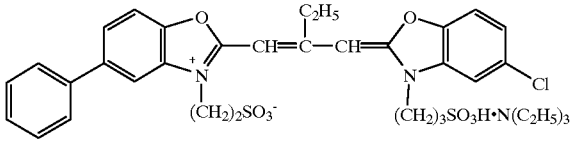
SD-7
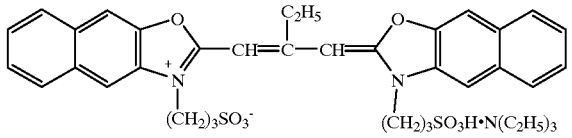

-continued
SD-8
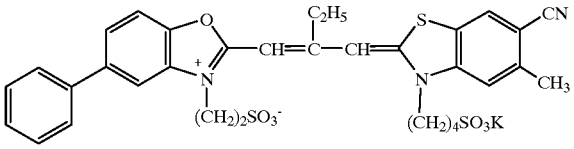
SD-9
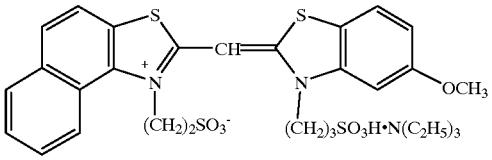
SD-10
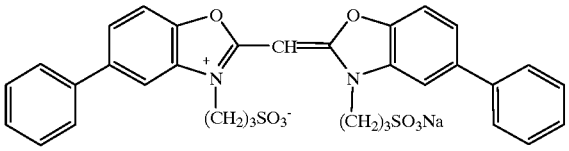
WAX-1
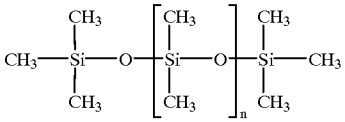
Mw = 3,000
D-1
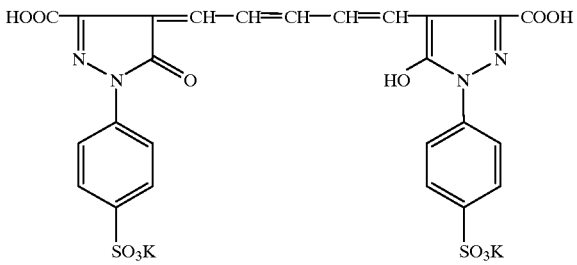
PM-1
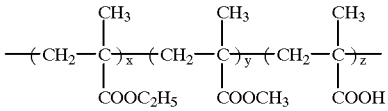
x: y: z: = 3: 3: 4
PM-2
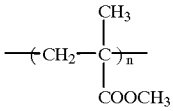
n: Polymerization degree
UV-1
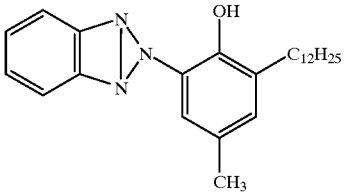
UV-2
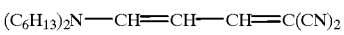

-continued

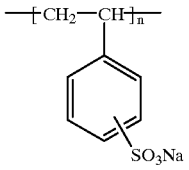

n: Polymerization degree

V-1

ASE-1 (Mixture)

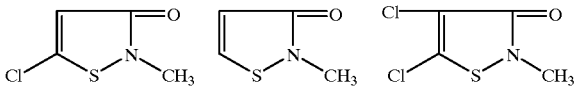

(A) (B) (C)

A: B: C: = 50: 46: 4 (molar ratio)

Samples 101 to 110 were each processed according to the following procedure.

Processing:

| Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 55 ± 5.0° C. | — |

*Amounts per $m^2$ of photographic material

A color developer, bleach, fixer and stabilizer each were prepared according to the following formulas.

Color developer and replenisher thereof:

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-(β-hydroxyethyl)-aniline sulfate | 4.5 g | 6.3 g |
| Diethylenetriaminepentaacetic acid | 3.0 g | 3.0 g |
| Potassium hydroxide | 1.2 g | 2.0 g |

Water was added to make 1 liter in total, and the pH of the developer and its replenisher were each adjusted to 10.06 and 10.18, respectively with potassium hydroxide and sulfuric acid.

Bleach and replenisher thereof:

| | Worker | Replenisher |
|---|---|---|
| Water | 700 ml | 700 ml |
| Ammonium iron (III) 1,3-diaminopropanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher thereof were adjusted to 4.4 and 4.0, respectively, with ammoniacal water or glacial acetic acid.

Fixer and replenisher thereof:

| | Worker | Replenisher |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of the fixer and replenisher thereof were adjusted to 6.2 and 6.5, respectively, with ammoniacal water or glacial acetic acid.

Stabilizer and replenisher thereof:

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Evaluation of Sensitivity and Graininess

Samples 101 to 105 were exposed through an optical wedge, to white light at 3.2 CMS for 1/200 sec. and processed according to the process described above. From an obtained characteristic curve of each sample was determined a green sensitivity. Thus, the sensitivity was shown as a relative value of reciprocal of exposure necessary for giving a density of fog density plus 0.30 of a magenta density, based on the sensitivity of Sample 101 being 100.

Graininess was evaluated based on RMS glanularity (1000 times density variation produced when the density of a fog density plus 0.3 was scanned with a microdensitometer with an aperture scannong area of 250 $\mu m^2$), and is shown as a relative value, based on tthat of Sample 101 being 100. The less the value, the better the graininess. Results thereof are shown in Table 2.

TABLE 2

| Sample No. | Emulsion | Compound | Sensitivity | Graininess |
|---|---|---|---|---|
| 101 (Comp.) | Em-1 | — | 100 | 100 |
| 102 (Inv.) | Em-2 | CL-61 | 128 | 92 |
| 103 (Inv.) | Em-3 | CL-94 | 115 | 94 |
| 104 (Inv.) | Em-4 | CL-91 | 117 | 93 |
| 105 (Inv.) | Em-5 | CL-109 | 125 | 90 |

As is apparent from Table 2, Samples 102 to 105 in which inventive emulsions Em-2 to Em-5 were employed, exhibited superior sensitivity and graininess to Samples 101 using comparative emulsions Em-1.

EXAMPLE 2

Preparation of Comparative Emulsion Em-11

Emuslsion Em-11 was prepared in a manner similar to Emulsion Em-1, except that solutions A-2 and C-2 were replaced by solutions A-3 and C-3, respectively.

| | | |
|---|---|---|
| A-3 Solution | | |
| Ossein gelatin | 519.9 | g |
| 10% Surfactant (EO-1) methanol solution | 1.5 | ml |
| Seed emulsion (T-1) | 5.3 | mol equivalent |
| Water to make | 18.0 | lit. |
| C-3 Solution | | |
| Potassium bromide | 979 | g |
| Potassium iodide | 87.2 | g |
| Water to make | 2500 | ml |

Preparation of Emulsions Em-12 to Em-17

Emulsions Em-12 to Em-17 were each prepared in a manner similar to Emulsion Em-11, except that reduction sensitization was applied in a manner similar to emulsion Em-2 in Example 1; prior to desalting, compound CL-61, CL-94, CL-91, CL-109, BR-61 and BR-109 were respectively added, in the form of a 10% aqueous solution, in an amount of 3.0 mol %, based on total silver halide; the pH was raised to 9.5 and after maintained for 5 min., the pH was lowered to 5.0.

Using emulsions Em-11 to Em-17, multilayered color photographic material samples Ill to 117 were prepared in a manner similar to Example 1 and similarly evaluated. Results thereof are shown in Table 3.

TABLE 3

| Sample No. | Emulsion | Compound | Sensitivity | Graininess |
|---|---|---|---|---|
| 111 (Comp.) | Em-11 | — | 100 | 100 |
| 112 (Inv.) | Em-12 | CL-61 | 121 | 92 |
| 113 (Inv.) | Em-13 | CL-94 | 115 | 95 |
| 114 (Inv.) | Em-14 | CL-91 | 116 | 94 |
| 115 (Inv.) | Em-15 | CL-109 | 122 | 90 |
| 116 (Inv.) | Em-16 | BR-61 | 110 | 96 |
| 117 (Inv.) | Em-17 | Br-109 | 115 | 96 |

As is apparent from Table 3, Samples 112 to 117 in which inventive emulsions Em-12 to Em-17 were employed, exhibited superior sensitivity and graininess to Samples 111 using comparative emulsions Em-11.

EXAMPLE 3

Preparation of Multilayer Color Photographic Material

Multilayer color photographic material samples 122 and 123 were prepared in a manner similar to Sample 101 of Example 1, except that after spectral sensitization and chemical sensitization, compound CL-61 ot CL-109 was added in the form of an aqueous 10% solution, in an amount of 1.0 mol %, based on total silver halide. Further, Samples 124 and 125 were prepared in a manner similar to Sample 101 of Example 1, except that after spectral sensitization and chemical sensitization, compound BR-61 ot BR-109 was added in the form of an aqueous 10% solution, in an amount of 1.0 mol %, based on total silver halide.

Samples 101 and 122 to 125 each were exposed, processed and evaluated with respect to sensitivity and graininess in a manner similar to Example 1. Results thereof are shown in Table 4.

TABLE 4

| Sample No | Emulsion | Compound | Sensitivity | Graininess |
|---|---|---|---|---|
| 101 (Comp.) | Em-1 | — | 100 | 100 |
| 122 (Inv.) | Em-1 | CL-61 | 120 | 95 |
| 123 (Inv.) | Em-1 | CL-109 | 118 | 95 |
| 124 (Inv.) | Em-1 | BR-61 | 111 | 97 |
| 125 (Inv.) | Em-1 | BR-109 | 116 | 96 |

As is apparent from Table 4, Samples 122 to 125 exhibited superior sensitivity and graininess to Samples 101.

EXAMPLE 4

Preparation of Seed Emulsion T-2

A monodispersed, spherical seed grain emulsion t-2 was prepared according to the following procedure.

| | | |
|---|---|---|
| A-4 Solution | | |
| Ossein gelatin | 80 | g |
| Potassium bromide | 47.4 | g |
| 10% Surfactant (EO-1) methanol solution | 20 | ml |
| Water to make | 8.0 | lit. |
| B-4 Solution | | |
| Silver nitrate | 1200 | g |
| Water to make | 1.6 | lit. |
| C-4 Solution | | |
| Ossein gelatin | 32.2 | g |
| Potassium bromide | 840 | g |
| Water to make | 1.6 | lit. |
| D-4 Solution | | |
| Ammoniacal water (28%) | 470 | ml |

To solution A-4 with stirring at 40° C., solution B-4 and C-4 were added by the double jet method for a period of 11 min. to form silver halide nucleus grains, while the pBr was maintained at 1.6. Then, the temperature was lowered to 30° C. in 12 min. and ripening was conducted for a period of 18 min. Then, solution D-4 was added thereto for a period of 1 min. and subsequently ripening was further conducted for a period of 5 min. After the pH adjusted to 6.0, the emulsion was desalted. From electron microscopic observation of the resulting seed emulsion, it was proved that the emulsion was comprised of monodispersed silver halide seed grains having two parallel twin planes, an average grain diameter (equivalent circle diameter) of 0.43 μm and a grain diameter distribution of 20%.

Preparation of Comparative Emulsion Em-31

Comparative emulsion Em-31 was prepared using the following solutions.

| | |
|---|---|
| A-5 Solution | |
| Ossein gelatin | 268.2 g |
| 10% Surfactant (EO-1) methanol solution | 1.5 ml |
| Seed emulsion (T-2) | 0.341 mol equivalent |
| Aqueous 28 wt % ammonia solution | 528 ml |
| Aqueous 56 wt % acetic acid solution | 795 ml |
| Water to make | 5930 ml |
| B-5 Solution | |
| 3.5N Ammoniacal silver nitrate solution (The pH was adjusted to 9.0 with ammonium nitrate.) | 2675 ml |
| C-5 Solution | |
| 3.5 N potassium bromide aqueous solution containing 4.0 wt % gelatin | 2675 ml |
| D-5 Solution | |
| Fine grain emulsion* comprised of 3.0 wt. % gelatin and fine silver iodide grains (average diameter of 0.05 μm | 0.844 mol |
| E-5 Solution | |
| 1.75 N potassium bromide solution | Necessary amount |
| F-5 Solution | |
| Aqueous 56% acetic acid solution | Necessary amount |

*Preparation
To 5000 ml of a 6.0 wt. % gelatin aqueous solution containing 0.06 mol potassium iodide was added 2000 ml of an aqueous solution containing 7.06 mol silver nitrate and 2000 ml of an aqueous solution containing 7.06 mol potassium iodide at a constant flow rate for 10 min. During addition, the pH and temperature were maintained at 2.0 with nitric acid and at 40° C. After completing addition, the pH was adjusted to 6.0 with a sodium carbonate aqueous solution. The final weight was 12.53 kg.

To solution A-5 maintained at 70° C. in a reaction vessel, solutions B-5, C-5 and D-5 were added with vigorously stirring by the double jet addition, wherein, taking into account a critical growth rate, solutions B-5, C-5 and D-5 were added at an accelerated flow rate so that production of fine grains other than growing seed grains and widening of grain diameter distribution due to Ostwald ripening between growing grains did not occur. Addition of solution D-5 was carried out in such a manner that the molar ratio of D-5 to B-5 was varied with time, as shown in Table 5, and multi-structured core/shell type silver halide grains were prepared. Using solutions E-5 and F-5, the pH and pAg were adjusted as shown in Table 5. The pH and pAg were measured using a glass electrode and a silver sulfide electrode. After completing grain formation, desalting was carried out according to the method described in JP-A 5-72658 and adding gelatin, the emulsion was redispersed and the pAg, and pH were respectively adjusted to 8.06 and 5.8 at 40° C. From electron microscopic observation of silver halide emulsion grains of emulsion Em-31, it was proved that the resulting emulsion was comprised of octahedral twinned silver halide grains substantially comprised of (111) surface plane and having an average diameter of 1.38 μm and a grain diameter distribution of 13%. Preparation of Inventive Emulsion Em-32 to Em-37

Emulsions Em-32 to Em-37 were each prepared in a manner similar to Emulsion Em-31, except that at the time of 174.6 min. of the addition time in Table 5, addition of solutions B-5 and C-5 was interrupted , compound CL-61, CL-94, CL-91, CL-109, BR-61 and BR-109 were respectively added, in the form of a 10% aqueous solution, in an amount of 4.0 mol %, based on total silver halide, the pH was raised to 9.5 and after maintained for 5 min., the pH was lowered to 6.5.

TABLE 5

| Addition Time (min) | Average size (μm) | Molar ratio D-5/B-5* | pH | pAg |
|---|---|---|---|---|
| 0.0 | 0.428 | 10.3 | 7.0 | 7.8 |
| 32.3 | 0.587 | 10.3 | 7.0 | 7.8 |
| 53.2 | 0.675 | 10.3 | 7.0 | 7.8 |
| 70.1 | 0.734 | 30.0 | 7.0 | 7.8 |
| 115.6 | 0.905 | 30.0 | 7.0 | 7.8 |
| 115.6 | 0.905 | 30.0 | 6.5 | 9.4 |
| 145.7 | 0.972 | 10.3 | 6.5 | 9.4 |
| 155.0 | 0.988 | 10.3 | 6.5 | 9.4 |
| 174.6 | 1.077 | 7.7 | 6.5 | 9.4 |
| 174.6 | 1.077 | 0.0 | 6.5 | 9.4 |
| 196.0 | 1.277 | 0.0 | 6.5 | 9.7 |
| 203.0 | 1.380 | 0.0 | 6.5 | 9.7 |

*Molar ratio of solution D-5 to solution B-5

Using each of the emulsions, Em-31 to Em-37, photographic material samples 131 to 137 were prepared in a manner similar to Example 1 and similarly evaluated. Results theeof are shown in Table 6.

TABLE 6

| Sample No. | Emulsion | Compound | Sensitivity | Graininess |
|---|---|---|---|---|
| 131 (Comp.) | Em-31 | — | 100 | 100 |
| 132 (Inv.) | Em-32 | CL-61 | 118 | 92 |
| 133 (Inv.) | Em-33 | CL-94 | 115 | 95 |
| 134 (Inv.) | Em-34 | CL-91 | 116 | 96 |
| 135 (Inv.) | Em-35 | CL-109 | 121 | 90 |
| 136 (Inv.) | Em-36 | BR-61 | 105 | 97 |
| 137 (Inv.) | Em-37 | BR-109 | 110 | 96 |

As is apparent from Table 6, Samples 132 to 137 in which inventive emulsions Em-32 to Em-37 were employed, exhibited superior sensitivity and graininess to Samples 131 using comparative emulsions Em-31.

EXAMPLE 5

Preparation of Comparative Emulsion Em-41

To 1000 ml of a 2% gelatin aqueous solution maintained at 40° C. were simultaneously added solutions A and B by the double jet method for a period of 30 min., while the pAg and pH were kept at 6.6 and 2.0, respectively and then solutions C and D were simultaneously added by the double jet method for a period of 180 min., while the pAg and pH were kept at 7.3 and 5.8, respectively. The pAg was controlled by the method described in JP-A 59-45437 and the pH was adjusted using aqueous sulfuric acid and sodium hydroxide solutions.

| | |
|---|---|
| A-Solution | |
| Sodium chloride | 1.03 |
| Potassium bromide | 0.006 g |
| Water to make | 50 ml |
| B-Solution | |
| Silver nitrate | 3.00 g |
| Water to make | 50 ml |
| C-Solution | |
| Sodium chloride | 103.0 g |

-continued

| | |
|---|---|
| Potassium bromide | 0.63 g |
| Water to make | 600 ml |
| D-Solution | |
| Silver nitrate | 300 g |
| Water to make | 600 ml |

After completing addition, the resulting emulsion was desalted using a 5% aqueous solution of Demol N (available from Kao-Atlas Corp.) and an aqueous 20% magnesium sulfate solution, and were further mixed with an aqueous gelatin solution to obtain an emulsion Em-41 comprised of monodisperse cubic grains having an average size of 0.70 μm and a variation coefficient of grain size distribution of 7%.

Preparation of Inventive Emulsion Em-42 to Em-47

Emulsions Em-42 to Em-47 were each prepared in a manner similar to Emulsion Em-41, except that addition of solutions C and D was interrupted , compound BR-61, BR-94, Br-91, BR-109 CL-61 and CL-109, were respectively added, in the form of a 10% aqueous solution, in an amount of 4.0 mol %, based on total silver halide, the pH was raised to 9.5 and after maintained for 5 min., the pH was lowered to 5.8. Emulsion Em-41 to Em-47 each were optimally subjected to chemical sensitization and sensitizing dyes SD-6, SD-7 and SD-8 were added to each emulsion in an amoint of $1.1\times10^{-4}$ mol, $2.0\times10^{-4}$ and $0.3\times10^{-4}$ mol per mol of silver, respectively.

Using these emulsions were prepared photographic material samples 141 to 147, comprising a support having thereon the following layers:

1st Layer (Emulsion layer):

Green-sensitive emulsion layer containing 1.8 g of each of chemically and spectrally sensitized emulsions described above, 1.9 g gelatin and a dispersion of 0.06 g DNP (di-t-nonylphenol), in which 0.2 g magenta coupler {1-(2,4,6-trichlorophenyl)-3-[3-(2,4-di-t-amylphenoxyacetoamido)-benzamido]-5pyrazolone} was dissoled, and 2nd Layer (Protective layer):

Layer containing 1.5 g gelatin and a dispersion of 0.11 g DBP (dibutyl phthalate), in which 0.2 g antistaining agent was dissolved.

To each layer described above were incorporated optimal amounts of a gelatin hardener and surfactant. Samples 141 to 147 each were exposed to green light through a sensotometric optical wedge and evaluated similarly to Example 1. Results thereof are shown in Table 7.

TABLE 7

| Sample No. | Emulsion | Compound | Sensitivity | Graininess |
|---|---|---|---|---|
| 141 (Comp.) | Em-41 | — | 100 | 100 |
| 142 (Inv.) | Em-42 | BR-61 | 118 | 92 |
| 143 (Inv.) | Em-43 | BR-94 | 115 | 95 |
| 144 (Inv.) | Em-44 | BR-91 | 116 | 96 |
| 145 (Inv.) | Em-45 | BR-109 | 121 | 90 |
| 146 (Inv.) | Em-46 | CL-61 | 105 | 97 |
| 147 (Inv.) | Em-47 | CL-109 | 110 | 96 |

As is apparent from Table 7, Samples 142 to 147 in which inventive emulsions Em-42 to Em-47 were employed, exhibited superior sensitivity and graininess to Samples 141 using comparative emulsions Em-41.

What is claimed is:

1. A method for preparing a silver halide emulsion comprising the steps of:

(1) forming a silver halide grain emulsion, (2) subjecting the formed silver halide emulsion to desalting to remove soluble salts, (3) subjecting the silver halide emulsion to spectral and/or chemical sensitization, and (4) preparing a coating solution using the spectrally and/or chemically sensitized silver halide emulsion, wherein in any of the steps (1) to (4), a compound represented by the following formula (I) is incorporated into the silver halide emulsion:

$$\{X—(L_1)_{n1}\}_{n2}—L_2—(SOL)_m \qquad \text{formula (I)}$$

wherein

X represents a chlorine atom or a bromine atom;

$L_1$ is represented by formula (II):

$$—C(R_1)(R_2)—CH(R_3)—EWG— \qquad \text{formula (II)}$$

wherein R1, R2 and R3 each represent a hydrogen atom or a substituent; and EWG represents —COO—, —OCO—, —$SO_2$—, —CON($R_4$)—, —N($R_4$)CO—, —CSN($R_4$)—, —N($R_4$)CS—, —N($R_4$)—, —O—, —S—, —CO—, —CS—, —COCO—, —$SO_2$N($R_4$)— or —N($R_4$)$SO_2$—, in which $R_4$ represents a hydrogen atom, an alkyl group or an aryl group;

$L_2$ represents a bivalent linkage group, which is an aromatic group;

SOL represents a water-solubilizing group;

n1 is 1; and m and n2 each are an integer of 1 to 4.

2. The method of claim 1, wherein SOL represents a carboxy group, sulfo group, hydroxy group or quaternary ammonium group.

3. The method of claim 1, wherein in step (1), said compound is incorporated into the silver halide emulsion after reaching 80% of the final grain, based on silver.

4. The method of claim 1, wherein the compound is incorporated into the emulsion after completing step (2) and before starting step (3), or after completing step (3) and before stating step (4).

5. The method of claim 1, wherein the compound is incorporated in an amount of, $1\times10^{-7}$ to 30 mol %, based on silver halide.

6. The method of claim 1, wherein the incorporated compound is allowed to react with a base or a nucleophilic reagent to release a chloride or bromide ion.

7. The method of claim 1, wherein the silver halide emulsion formed in step (1) comprises tabular silver halide grains.

8. The method of claim 7, wherein said tabular grains each have dislocation lines.

9. The method of claim 1, wherein the silver halide emulsion used in step (4) comprises silver halide grains which have been subjected to reduction sensitization.

10. The method of claim 1, wherein $L_2$ is a phenylene group.

11. The method of claim 1, wherein in formula (I) $L_2$ is a phenylene group; and SOL is a carboxy group, a sulfo group, an hydroxy group or a quaternary ammonium group.

* * * * *